US009206518B2

(12) United States Patent
Beeler

(10) Patent No.: US 9,206,518 B2
(45) Date of Patent: Dec. 8, 2015

(54) ALUMINUM ELECTROLYSIS CELL WITH COMPRESSION DEVICE AND METHOD

(75) Inventor: Richard M. Beeler, Saxonburg, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/609,759

(22) Filed: Sep. 11, 2012

(65) Prior Publication Data

US 2013/0062217 A1 Mar. 14, 2013

Related U.S. Application Data

(60) Provisional application No. 61/533,307, filed on Sep. 12, 2011.

(51) Int. Cl.

| | |
|---|---|
| ***C25C 3/06*** | (2006.01) |
| ***C25C 3/08*** | (2006.01) |
| ***C25C 7/00*** | (2006.01) |
| ***C25C 3/00*** | (2006.01) |
| ***C25C 7/06*** | (2006.01) |
| ***C25C 1/22*** | (2006.01) |
| ***C25C 3/16*** | (2006.01) |

(52) U.S. Cl.

CPC ... *C25C 7/06* (2013.01); *C25C 1/22* (2013.01); *C25C 3/08* (2013.01); *C25C 3/16* (2013.01)

(58) Field of Classification Search

CPC ..... C25C 3/06; C25C 3/00; C25C 3/08; C25C 7/005

USPC ..... 205/372, 374; 204/193, 194, 242

See application file for complete search history.

(56) References Cited

U.S. PATENT DOCUMENTS

| | | | | |
|---|---|---|---|---|
| 3,499,831 | A | 3/1970 | McMinn et al. | |
| 3,630,880 | A * | 12/1971 | Howard | 204/284 |
| 3,867,562 | A | 2/1975 | Fischer et al. | |
| 6,113,756 | A | 9/2000 | Juric et al. | |
| 6,231,745 | B1 | 5/2001 | Homley et al. | |
| 6,294,067 | B1 | 9/2001 | Gauthier et al. | |
| 6,387,237 | B1 | 5/2002 | Homley et al. | |

(Continued)

FOREIGN PATENT DOCUMENTS

| | | |
|---|---|---|
| SU | 1260412 | 9/1986 |
| WO | 9534696 | 12/1995 |

(Continued)

OTHER PUBLICATIONS

"Influence of Temperature and Contact Pressure Between Cast Iron and Cathode Carbon on Contact Resistance", Frank Hiltmann & Jorg Mittag, The Minerals, Metals & Materials Society, Light Metals, 1996, pp. 277-283.

"An Analytical Model for Cathode Voltage Drop in Aluminum Reduction Cells", Richard Beeler, Alcoa Inc., The Minerals, Metals & Materials Society, Light Metals 2003, pp. 241-245.

*Primary Examiner* — Zulmariam Mendez

(74) *Attorney, Agent, or Firm* — Greenberg Traurig, LLP

(57) ABSTRACT

In accordance with the instant disclosure, aluminum electrolysis cells having reduced cathode voltage drop and methods of operating the same are provided. More particularly, the instant disclosure provides a compression device for applying a force to an end of the current collector subassembly to improve the contact, thereby reducing the joint resistance across the interface between the cathode block and the current collector subassembly. The compression device is used in conjunction with the systems and methods of the instant disclosure.

22 Claims, 23 Drawing Sheets

(56) References Cited

U.S. PATENT DOCUMENTS

| | | | |
|---|---|---|---|
| 2006/0151333 | A1 | 7/2006 | Banek |
| 2008/0308415 | A1 | 12/2008 | Hiltmann et al. |

FOREIGN PATENT DOCUMENTS

| | | |
|---|---|---|
| WO | 01/63014 | 8/2001 |
| WO | 2004/059039 | 7/2004 |
| WO | 2005/098093 | 10/2005 |

OTHER PUBLICATIONS

R. Beeler, An Analytical Model for Cathode Voltage Drop in Aluminum Reduction Cells, Light Metals 2003, pp. 241-245, The Minerals, Metals & Materials Society.

F. Hiltmann et al., Influence of Temperature and Contact Pressure Between Cast Iron and Cathode Carbon on Contact Resistance, Light Metals 1996, pp. 277-283, The Minerals, Metals & Materials Society.

International Search Report for International Application No. PCT/US2012/054630, Feb. 12, 2013.

* cited by examiner (After)

(Before)

ALUMINUM ELECTROLYSIS CELL WITH COMPRESSION DEVICE AND METHOD

CROSS-REFERENCE TO RELATED APPLICATIONS

This application claims priority to U.S. Application Ser. No. 61/533,307, entitled "Aluminum Electrolysis Cell with Compression Device and Method" filed on Sep. 12, 2011, which is incorporated by reference in its entirety.

BACKGROUND

During conventional aluminum production, electricity is supplied to the electrolytic cell in order to drive the production of aluminum. Voltage is lost in the cell due to inefficiencies in the design, particularly in the electrical contact sites as the electrical current from the cell is transferred out of the system. This loss of voltage is commonly known as cathode voltage drop, or "CVD". Poor contact caused during the cathode assembly formation and/or through the continued operation of the cell at extreme conditions (e.g. high temperatures) contributes to CVD. The voltage loss from CVD in operating electrolysis cells can add up to millions of dollars per year, per plant.

SUMMARY OF THE DISCLOSURE

Broadly, the present disclosure relates to systems and methods for producing aluminum in electrolytic cells, while simultaneously reducing CVD. More particularly, the instant disclosure relates to utilizing a compression device (sometimes called an axial compression device or a collector bar compression device) in conjunction with an electrolysis cell. The compression device compresses an end of the collector bar (or collector bar subassembly end) to maintain and/or improve the contact (e.g. electrical contact) between various electrolysis cell components (e.g. the cathode collector bar(s) and the cathode). In some embodiments, the compression device improves contact between cathode assembly subcomponents, reducing joint electrical resistance (i.e. electrical resistance across the joint of at least two components), thus resulting in a reduction in CVD in the cell.

In some embodiments, the compression device promotes contact between the slot of the cathode block and the current collector subassembly (e.g. current collector bar with optional sheath/cover/joint of conductive material). In one embodiment, the compression device is attached to at least one end of the current collector subassembly (or current collector bar) in order to impart force (or pressure) onto at least one end of the current collector subassembly.

In one embodiment, as the compression device compresses the current collector subassembly (e.g. in an axial direction), the current collector subassembly expands in a transverse direction, against, and into contact with the surface of the slot. In one embodiment, as the current collector subassembly expands transversely, it conforms itself to the surface of the slot. Thus, in some embodiments, the compression device increases the surface area of contact (and reduces the electrical resistance) between the current collector subassembly and the slot of the cathode block. In one embodiment, as the amount of shared surface area between the block and bar increases, the electrical resistance at the joint decreases. Thus, in some embodiments, the compression device reduces CVD in the electrolysis cell.

Joint resistance in the cathode assembly may be attributed to one or more mechanisms and/or sources. Some non-limiting examples of sources of joint resistance in the cathode assembly include: creep, phase change, spacer standoff, voids, non-conforming surfaces, and combinations thereof. In various embodiments, voids, phase changes, and creep occur respectively before, during, and after the startup of a pot (cell). In some embodiments, a resulting surface non-conformity between the bar and slot has components that develop in each of these phases. The instant disclosure prevents, reduces and/or eliminates joint resistivity (i.e. high electrical resistance) by utilizing a compression device to apply stress to the components of the cathode assembly, thus conforming the cathode collector bar subassembly. In some embodiments, applying stress to the current collector bar while the cell is cold, during start up, or at operating conditions (e.g. high temperature and pressure) promotes bar deformation (e.g. creep) within the cathode block slot in a way which improves the joint during operation of the cell at operating conditions (e.g. elevated temperatures).

In some embodiments, the compression device compresses (e.g. imparts force) on the current collector subassembly when: (1) the cell is idle; (2) during start-up; (3) during operating conditions, and/or (4) combinations thereof. In one or more of these embodiments, the compression device imparts a continuous amount of force on the end(s) of the current collector subassembly. In one or more embodiments, the compression device imparts a variable amount of force on the end(s) of the current collector subassembly (e.g. based on a feedback loop). Thus, in one or more embodiments, the compression device: prevents an increase in CVD, reduces CVD, and/or maintains low levels of CVD across a cathode assembly. In some embodiments, the joint's contribution to CVD (i.e. the cathode collector subassembly/cathode slot joint) is eliminated.

In one embodiment, the compression device is on the outer ends of the cathode collector bars (i.e. the ends that extend from the cell). In one embodiment, the compression device is on the inner ends of the cathode collector bars (i.e. the ends that abut inside the cathode block/inside the cell). In one embodiment, the compression devices are on the outer and inner ends of the cathode collector bars.

In some embodiments, the compression device includes one or more of: a spring, a screw, a brace, a bracket, a vise, a piston, a balloon, a diaphragm, a bladder, a clamp, a bellows, a lever, a jack, a ram, and combinations thereof. In one embodiment, in order to impart force, the compression device is tightened into place onto at least one end of the current collector bar. In one embodiment, the compression device provides an elastic resistance to at least one end of the collector bar. In some embodiments, the compression device imparts compressive force based upon the temperature of the compression device and/or cell components.

In one embodiment, the compression device includes at least one spring (e.g. elastic resistance device) and a brace. In this embodiment, the brace provides resistance to the compressed spring so that it applies force to the end of the collector bar that extends from the cell.

In one embodiment, the compression device includes a bracket and a screw assembly. In this embodiment, the bracket is movably adjusted with the screw/threaded assembly to put the bracket into contact with, and apply force to, the bar. In some embodiments, the compression device includes a hydraulic piston. In this configuration, the piston applies varying amounts of force to the bar.

In one embodiment, the compression device is an expandable member (sometimes referred to as, e.g. an expandable balloon). In some embodiments, the balloon is a metal material (e.g. metallic). In some embodiments, the balloon is a ferritic/magnetic stainless steel, including as non-limiting examples 304SS, 304L, 430, 410, and 409. Some non-limiting example balloon materials include: carbon steel, stainless steel, graphite, and steel. In one embodiment, the balloon includes at least one wall that seals in an inner void. In various embodiments, the balloon is of different shapes, including rectangular, oval, circular, and the like. In other embodiments, the balloon comprises two substantially planar faces with rounded edges. As some non-limiting examples, the dimension of the balloon includes: a rectangular shape, a square shape, a polygonal shape, an oval shape, and/or a rounded shape. In some embodiments, the balloon comprises corners. In some embodiments, the balloon comprises rounded edges.

In yet another aspect of the invention, a method is provided. The method comprises: forming at least one sidewall around an inner void to provide a metallic body having an opening; inserting an expandable material into the void via the opening (e.g. pre-pressurized void with gas); closing the metallic body, thus completely enclosing the void having an expandable material therein.

In another aspect, a method of making an expandable member is provided. The method comprises: aligning a plurality of (at least two) metallic walls to provide a void therein; and sealing the plurality of walls.

In one embodiment, the expandable member is cast from a mold. In one embodiment, the expandable member is extruded to form. In one embodiment, the expandable member is machined. In one embodiment, the expandable member portions are adhered together. In one embodiment, the expandable member is welded together. In one embodiment, the expandable member is screwed together. In one embodiment, the expandable member is bolted together. In one embodiment, the expandable member is mechanically fastened together.

In one embodiment, the method comprises inserting a material (e.g. gas, expandable material, inert material) into the void (sometimes called an inner void or central region).

In some non-limiting embodiments, sealing includes welding, mechanically fastening, adhering, riveting, bolting, screwing, and the like.

In some embodiments, the thickness of the wall(s) varies. In some embodiments, the wall thickness is continuous throughout. In some embodiments, the wall is: at least about 1/16" thick; at least about 1/8" thick; at least about 1/4" thick, at least about 1/2" thick, at least about 3/4" thick, or at least about 1' thick.

In some embodiments, the wall is: not greater than about 1/16" thick; not greater than about 1/8" thick; not greater than about 1/4" thick, not greater than about 1/2" thick, not greater than about 3/4" thick, or not greater than about 1" thick.

In some embodiments, the void is filled with air (e.g. of atmospheric composition). In some embodiments, the void comprises a gas (e.g. pure or mixed composition). In some embodiments, the void comprises an inert material (e.g. non-reactive at elevated temperatures (e.g. below 1000° C.). In some embodiments, the void comprises gas at a pressure (e.g. above atmospheric pressure). In some embodiments, the void comprises combinations of at least two of air (e.g. of atmospheric composition), a gas (e.g. pure or mixed composition), an expandable material, and/or an inert material (i.e. filler material). In some embodiments, the void comprises gas at a pressure (e.g. above atmospheric pressure). In some embodiments, the void comprises an expandable material. In some embodiments, the void comprises combinations thereof.

In some embodiments, the pressure inside the balloon (before start up/at ambient pressure and temperature) is: at least about 0 PSIG; at least about 5 PSIG; at least about 10 PSIG; at least about 15 PSIG, at least about 20 PSIG; at least about 25 PSIG; at least about 30 PSIG; at least about 35 PSIG; at least about 40 PSIG; at least about 45 PSIG; at least about 50 PSIG; at least about 55 PSIG; at least about 60 PSIG; at least about 65 PSIG; at least about 70 PSIG; at least about 75 PSIG; at least about 80 PSIG; at least about 85 PSIG and/or at least about 90 PSIG.

In some embodiments, the pressure inside the balloon (before start up/at ambient pressure and temperature) is: not greater than about 0 PSIG; not greater than bout 5 PSIG; not greater than about 10 PSIG; not greater than about 15 PSIG, not greater than about 20 PSIG; not greater than about 25 PSIG; not greater than about 30 PSIG; not greater than about 35 PSIG; not greater than about 40 PSIG; not greater than about 45 PSIG; not greater than about 50 PSIG; not greater than about 55 MG; not greater than about 60 PSIG; not greater than about 65 PSIG; not greater than about 70 PSIG; not greater than about 75 PSIG; not greater than about 80 PSIG; not greater than about 85 PSIG and/or not greater than about 90 PSIG.

In another embodiment, the cavity/void inside the balloon is pressurized before operation. For example, with the appropriate formation conditions and sealing operations, the internal conditions of the expandable member may be at least about atmospheric pressure, at least about 1.5 ATM; at least about 2 ATM, at least about 3 ATM, at least about 4 ATM, or at least about 5 ATM. In some embodiments, the expandable member comprises an internal pressure of: at least about 1 ATM; at least about 2 ATM; at least about 5 ATM; at least about 10 ATM; at least about 15 ATM; or at least about 20 ATM. For example, with the appropriate formation conditions and sealing operations, the internal conditions of the expandable member may be not greater than about atmospheric pressure, not greater than about 1.5 ATM; not greater than about 2 ATM, not greater than about 3 ATM, not greater than about 4 ATM, or not greater than about 5 ATM. In some embodiments, the expandable member comprises an internal pressure of: not greater than about 1 ATM; not greater than about 2 ATM; not greater than about 5 ATM; not greater than about 10 ATM; not greater than about 15 ATM; or not greater than about 20 ATM.

In some embodiments, the inner void takes up a portion of the volume of the expandable member. In some embodiments, the inner void is: at least about 5% by vol.; at least about 10% by vol.; at least about 15% by vol.; at least about 20% by vol.; at least about 25% by vol.; at least about 30% by vol.; at least about 35% by vol.; at least about 40% by vol.; at least about 45% by vol.; at least about 50% by vol.; at least about 55% by vol.; at least about 60% by vol.; at least about 65% by vol.; at least about 80% by vol.; at least about 85% by vol.; at least about 90% by vol.; at least about 95% by vol.; or at least about 98% by volume of the expandable member.

In some embodiments, the inner void is: not greater than about 5% by vol.; not greater than about 10% by vol.; not greater than about 15% by vol.; not greater than about 20% by vol.; not greater than about 25% by vol.; not greater than about 30% by vol.; not greater than about 35% by vol.; not greater than about 40% by vol.; not greater than about 45% by vol.; not greater than about 50% by vol.; not greater than about 55% by vol.; not greater than about 60% by vol.; not greater than about 65% by vol.; not greater than about 80% by vol.; not greater than about 85% by vol.; not greater than about 90% by vol.; not greater than about 95% by vol.; or not greater than about 98% by volume of the expandable member.

As used herein, expandable material refers to a material that expands or enlarges under different conditions. As non-limiting examples, the expansion is attributable to phase change, decomposition, and/or density change upon different temperature or pressure conditions. In one non-limiting example, the expandable material expands inside the balloon at increased temperature. As another example, at the increased temperature, the expandable undergoes a phase change (i.e. solid to gas) to increase volume at the increased temperature.

In some embodiments, gas (air) having an atmospheric composition is present inside the balloon and upon temperature elevation; at least some oxygen ($O_2$) present in the air is removed from the system (e.g. rusts) so that the pressure inside the void at elevated temperature (e.g. 900° C.) is about 3.2 ATM. In some embodiments, the pressure inside the balloon (e.g. in the void) drops as the balloon expands, so the material expansion and creep is selected a suitable expandable material to accommodate appropriate pressure increase inside the inner void. In some embodiments, there is a reduction in the inner pressure due to loss of oxygen (e.g. surface reactions with the balloon, like rust) and subsequent volume increase of the balloon (e.g. metal expansion).

Non-limiting examples of expandable materials include: any material that degrades to gas or decomposes to emit a gas at a temperature exceeding room temperature (e.g. 20-25 C). As some non-limiting examples, $MgCO_3$ (decomposes at 350° C.); $CaCO_3$ (Calcite, decomposes at 898° C.), or $CaCO_3$ (aragonite, decomposes at 825° C., where each of these materials releases carbon dioxide gas at elevated temperatures. Other non-limiting examples of expandable materials include any chemical that degrades at elevated temperatures, for example, temperatures exceeding about 800° C. (e.g. cell operating temperature, at least about 900° C., or at least about 930° C.). In some embodiments, the expandable material expands (via gas expansion, phase change, decomposition, and/or degradation) at temperatures below the temperature at which the expandable balloon is capable of expansion (e.g. thermal properties of metal). In some embodiments, the expandable balloon undergoes an increase in inner void pressure prior to any strain on the expandable balloon sidewalls and/or cathode collector subassembly components.

In some embodiments, at elevated temperature and pressure conditions inside the balloon, the gas and/or expandable material inside the balloon expand to push the balloon walls outward. In some embodiments, the rise from ambient temperature to cell operating temperature (e.g. 900° C.-930° C.) increases the internal absolute pressure by a factor of 4 inside the balloon.

In another embodiment, an inert material is used inside the expandable member. In one embodiment, the inert material is porous and/or particulate. As non-limiting examples, the inert material includes tabular alumina, gravel, aggregate, ceramic materials, and the like, which fill a portion of, or the entirety of, the cavity. In some embodiments, by utilizing an inert material, the size of the cavity could be large, while the amount of gas providing the pressure (i.e. the volume that is not occupied by inert material) would be small. With such an embodiment, it is possible to limit creep in the expandable member, (which would slow as the cavity expanded and pressure dropped). Also, with such an embodiment, the amount of gas that could potentially erupt from the expandable member during the pot operation is reduced as compared to an embodiment in which the entire void was filled with gas.

In some embodiments, the improved contact at the interface of the slot and the bar is measureable, correlated, and/or quantified by one or more characteristics. As non-limiting examples, the compression device causes a decrease in electrical resistance, an increase in surface area (between the cathode block slot and the cathode current subassembly, a dimensional change in the current collector subassembly (e.g. the amount of collector bar that extends from the cell), and combinations thereof.

When measuring the improved contact by a decreased electrical resistance, the resulting interface comprises a common surface area sufficient to reduce a measured cathode voltage drop across the electrolysis cell by a measureable amount.

In some embodiments, the resulting, improved contact at the interface comprises a common surface area sufficient to reduce a measured cathode voltage drop (e.g. across the cathode assembly) by: at least about 10 mV; at least about 20 mV; at least about 30 mV; at least about 40 mV; at least about 50 mV; at least about 60 mV; at least about 70 mV; at least about 80 mV; at least about 90 mV; 100 mV; at least about 120 mV; at least about 140 mV; or at least about 160 mV.

In some embodiments, the resulting, improved contact at the interface comprises a common surface area sufficient to reduce a measured cathode voltage drop (e.g. across the cathode assembly) by: not greater than about 10 mV; not greater than about 20 mV; not greater than about 30 mV; not greater than about 40 mV; not greater than about 50 mV; not greater than about 60 mV; not greater than about 70 mV; not greater than about 80 mV; not greater than about 90 mV; 100 mV; not greater than about 120 mV; not greater than about 140 mV; or not greater than about 160 mV.

In some embodiments, the electrical resistance at the joint is reduced by a factor of: at least about 3; at least about 5; at least about 10; at least about 20; at least about 40; at least about 60; at least about 80; or at least about 100.

In some embodiments, the electrical resistance at the joint is reduced by a factor of: not greater than about 3; not greater than about 5; not greater than about 10; not greater than about 20; not greater than about 40; not greater than about 60; not greater than about 80; or not greater than about 100.

In some embodiments, when measuring the improved contact by an increased surface area at the joint or interface between the cathode block and the current collector subassembly (or alternatively, joint material/cathode block slot), the improvement is measured as an increase in surface area. This is generally depicted, by comparing: (a) FIG. 8A with FIG. 8B, (b) FIG. 9A with FIG. 9B; (c) FIG. 10A with FIG. 10B; and/or (d) FIG. 10C with FIG. 10D, In some embodiments, the compression device increases the amount of contact (or common surface area) by: at least about 2%; at least about 4%; at least about 6%; at least about 8%; at least about 10%; at least about 15%; at least about 20%; at least about 40%; at least about 50%; at least about 75%; or at least about 100% (e.g. when no contact existed before the compression device was in place/operating on the end of the collector bar with a compressive force).

In some embodiments, the compression device increases the amount of contact (or common surface area) by: not greater than about 2%; not greater than about 4%; not greater than about 6%; not greater than about 8%; not greater than about 10%; not greater than about 15%; not greater than about 20%; not greater than about 40%; not greater than about 50%; not greater than about 75%; or not greater than about 100% (e.g. when no contact existed before the compression device was in place/operating on the end of the collector bar with a compressive force).

In some embodiments, when measuring the improved contact by a dimensional change in the current collector bar while the bar is under stress, the improved contact at the interface between the cathode block and the current collector bar is measured by the difference in dimension and/or length (e.g. along a longitudinal direction) of the collector bar as it protrudes from the wall of the electrolysis cell. By applying force in the form of compressive stress at one of the of collector bar, the bar decreases in length as it is compressed, thus entering into the electrolysis cell to a greater extent.

In some embodiments, the decrease in length of the bar is: at least about 0.1%; at least about 0.3%; at least about 0.5%; at least about 0.7%; at least about 1%; at least about 1.1%; at least about 1.3%; at least about 1.5%; at least about 1.7%; at least about 2%; or at least about 2.5%.

In some embodiments, the decrease in length of the bar is: not greater than about 0.1%; not greater than about 0.3%; not greater than about 0.5%; not greater than about 0.7%; not greater than about 1%; not greater than about 1.1%; not greater than about 1.3%; not greater than about 1.5%; not greater than about 1.7%; not greater than about 2%; or not greater than about 2.5%.

In some embodiments, as the bar decreases in length (i.e., less protrusion from the wall), the bar expands (i.e. increases) in width (e.g. along a transverse direction) to align in better contact with the surface area of the slot. In some embodiments, the bar exhibits a decrease in length along a longitudinal direction and an increase in width along a transverse direction.

In some embodiments, the improvement in electrical contact refers to an increase in the transverse dimension by: at least about 0.1%; at least about 0.3%; at least about 0.5%; at least about 0.7%; at least about 1%; at least about 1.1%; at least about 1.3%; at least about 1.5%; at least about 1.7%; at least about 2%; or at least about 2.5%.

In some embodiments, the improvement in electrical contact refers to an increase in the transverse dimension by: not greater than about 0.1%; not greater than about 0.3%; not greater than about 0.5%; not greater than about 0.7%; not greater than about 1%; not greater than about 1.1%; not greater than about 1.3%; not greater than about 1.5%; not greater than about 1.7%; not greater than about 2%; or not greater than about 2.5%.

In one embodiment, the improved contact at the interface is measured by a dimensional change of the bar under stress by not greater than 10% in a longitudinal direction (i.e. length) and not greater than 5% in a transverse direction (i.e. width).

In some embodiments, the compression device imparts compressive stress onto the current collector subassembly in various amounts, including: at least about 50 psi; at least about 100 psi; at least about 150 psi; at least about 200 psi; at least about 250 psi; or at least about 300 psi.

In some embodiments, the compression device imparts compressive stress onto the current collector subassembly in various amounts, including: not greater than about 50 psi; not greater than about 100 psi; not greater than about 150 psi; not greater than about 200 psi; not greater than about 250 psi; or not greater than 300 psi.

In some embodiments, the amount of force applied by the compression device to the current collector bar is large enough for the prevention, reduction, or elimination of gaps between the current collector bar and the cathode block. By eliminating, reducing, and/or preventing the gap, the compression device reduces CVD across the aluminum electrolysis cell and increases efficient removal of electric current from the system.

In some embodiments, the compression device imparts a resulting strain on the collector bar in a longitudinal axial) direction of: at least about −0.01%; at least about −0.02%; at least about −0.03%; at least about −0.04%/ at least about −0.05%; at least about −0.06%; at least about −0.07%; at least about −0.08%; at least about −0.09%; at least about −0.1%. In some embodiments, the compression device imparts a strain on the collector bar in the longitudinal (axial) direction of: at least about −0.1%; at least about −0.15%; at least about −0.2%; at least about −0.25%; at least about −0.3%; at least about −0.35%; at least about −0.4%; at least about −0.45%; at least about −0.5%; at least about −0.55%; at least about −0.6%; at least about −0.65%; at least about −0.7%; at least about −0.75%; at least about −0.8%; at least about −0.85%; at least about −0.9%; at least about −0.95%; or at least about −1%.

In some embodiments, the compression device imparts a resulting strain on the collector bar in a longitudinal (axial) direction of: not greater than about −0.01%; not greater than about −0.02%; not greater than about −0.03%; not greater than about −0.04%/ not greater than about −0.05%; not greater than about −0.06%; not greater than about −0.07%; not greater than about −0.08%; not greater than about −0.09%; not greater than about −0.1%. In some embodiments, the compression device imparts a strain on the collector bar in the longitudinal (axial) direction of: not greater than about −0.1%; not greater than about −0.15%; not greater than about −0.2%; not greater than about −0.25%; not greater than about −0.3%; not greater than about −0.35%; not greater than about −0.4%; not greater than about −0.45%; not greater than about −0.5%; not greater than about −0.55%; not greater than about −0.6%; not greater than about −0.65%; not greater than about −0.7%; not greater than about −0.75%; not greater than about −0.8%; not greater than about −0.85%; not greater than about −0.9%; not greater than about −0.95%; or not greater than about −1%.

In some embodiments, the compression device imparts a resulting strain on the collector bar in a transverse direction of: at least about 0.01%; at least about 0.02%; at least about 0.03%; at least about 0.04% at least about 0.05%; at least about 0.06%; at least about 0.07%; at least about 0.08%; at least about 0.09%; at least about 0.1%. In some embodiments, the compression device imparts a strain on the collector bar in the transverse direction of at least about 0.1%; at least about 0.15%; at least about 0.2%; at least about 0.25%; at least about 0.3%; at least about 0.35%; at least about 0.4%; at least about 0.45%; at least about 0.5%; at least about 0.55%; at least about 0.6%; at least about 0.65%; at least about 0.7%; at least about 0.75%; at least about 0.8%; at least about 0.85%; at least about 0.9%; at least about 0.95%; or at least about 1%.

In some embodiments, the compression device imparts a resulting strain on the collector bar in a transverse direction of not greater than about 0.01%; not greater than about 0.02%; not greater than about 0.03%; not greater than about 0.04%; not greater than about 0.05%; not greater than about 0.06%; not greater than about 0.07%; not greater than about 0.08%; not greater than about 0.09%; not greater than about 0.1%. In some embodiments, the compression device imparts a strain on the collector bar in the transverse direction of; not greater than about 0.1%; not greater than about 0.15%; not greater than about 0.2%; not greater than about 0.25%; not greater than about 0.3%; not greater than about 0.35%; not greater than about 0.4%; not greater than about 0.45%; not greater than about 0.5%; not greater than about 0.55%; not greater than about 0.6%; not greater than about 0.65%; not greater than about 0.7%; not greater than about 0.75%; not greater than about 0.8%; not greater than about 0.85%; not greater than about 0.9%; not greater than about 0.95%; or not greater than about 1%.

In one embodiment, the compression device is retrofitted onto existing electrolysis cells. In one embodiment, the compression device is a component or part of the electrolysis cell. Optionally, the compression device is manufactured integral with or as an attachable/detachable component with the walls of the cell, the electrical bus work of the cell, the cathode assembly, and/or the current collector subassembly.

In one aspect of the instant disclosure, an aluminum electrolysis cell is provided. The aluminum electrolysis cell includes: an anode; a cathode assembly; a liquid medium (e.g. molten salt bath); and the compression device. In one embodiment, the cathode assembly includes: a cathode block having a slot and a current collector subassembly. In one embodiment, the current collector subassembly is at least partially disposed in the slot of the cathode block. In some embodiments, the current collector subassembly is a bar, or a bar with a joint material which at least partially wraps (e.g. covers) the bar. In some embodiments, the compression device is attached to an end of the current collector subassembly and is configured to conform the current collector subassembly to the slot of the cathode block. As such, the interface between the current collector subassembly and the cathode block at the slot is maintained by the compression device.

In some embodiments, the liquid medium is located between the anode and the cathode assembly. Aluminum is produced in the cell from the liquid medium (also referred to as a molten material/electrolytic bath). In some embodiments, aluminum metal is produced at the interface between the liquid bath and the liquid metal and as it forms, the liquid aluminum accumulates on top of the cathode block.

In another aspect of the instant disclosure, an aluminum electrolysis cell is provided. In one embodiment, the aluminum electrolysis cell includes: an anode; a cathode assembly; a molten salt bath, and a compression device (e.g. axial compression device). In one embodiment, the cathode assembly includes a cathode block with a slot and a current collector subassembly. In one embodiment, the current collector subassembly includes a collector bar and a joint material. In some embodiments, the current collector subassembly is attached to the slot of the cathode block. The molten salt bath (e.g. electrolyte) is located between the anode and the cathode block.

In one embodiment, the axial compression device includes: a brace and at least one force imparting element. In one embodiment, the force imparting element is configured to attach to an end of the current collector bar, while the brace holds the element in place. In one embodiment, the force imparting element is configured to transversely expand the current collector bar via the application of an axial force to the current collector subassembly. As a non-limiting example, the transverse expansion is in a direction generally perpendicular to the direction of the axial (longitudinal) force. In some embodiments, the transverse expansion of the current collector bar conforms the current collector subassembly to the slot of the cathode block. As a non-limiting example, as the current collector bar transversely expands, the current collector bar maintains an interface between itself and the slot of the cathode block. In one embodiment, the force imparting element improves the contact between the cathode block and the current collector bar by up to about 2%.

In one embodiment, the compression device includes a compression detector. In some embodiments, the compression detector is located between the brace and the force imparting element and the compression detector is configured to measure the force imparted on the current collector bar. In one embodiment, compression of the bar is measured based on the amount of bar which extends from the wall of the cell. In one embodiment, the compression detector measures the length of the collector bar (e.g. the amount the collector bar protrudes from the cell). In one embodiment, the compression detector measures the width of the collector bar (e.g. the amount of transverse expansion of the bar.) In some embodiments, the compression detector measurements feed into a cell operating system (not shown) for example, as a real-time feedback loop to vary the amount of compression. In some embodiments, the compression is correlated based on the measured cell temperature, which affects the amount of deformation possible in the bar (i.e. through creep).

In another aspect of the instant disclosure, methods of making aluminum are provided. In one embodiment, the method of making aluminum includes the steps of: (a) producing aluminum in an aluminum electrolysis cell; (b) imparting a force on at least one end of a current collector subassembly; and (c) maintaining, due to the imparting force step, an improved contact between the slot of the cathode block and the current collector subassembly.

In some embodiments, the producing step refers to transmitting electrical current from an anode to a cathode assembly, via a liquid medium, to produce aluminum in the cell. In some embodiments, the imparting force step, refers to the applying force or pressure on at least one end of the current collector subassembly, via the compression device.

In one embodiment, the method includes: conforming the current collector subassembly to the cathode block to reduce the cathode voltage drop (CVD) by about 10 mV to about 100 mV. In one embodiment, the method includes: transversely expanding the current collector bar, via the imparting step, to maintain and/or improve the electrical contact between the current collector bar and the slot of the cathode block. In some embodiments, the resulting electrical resistance from the compression device is less than an initial electrical resistance (i.e. as measured without force from the support). In one embodiment, the method includes adjusting the imparted force to increase, decrease, or maintain the compression of the current collector bar at variable or continuous maintained conditions. In one embodiment, the method includes determining the force imparted on the end of the current collector subassembly.

These and other aspects, advantages, and novel features of the technology are set forth in part in the description that follows and will become apparent to those skilled in the art upon examination of the following description and Figures, or is learned by practicing the embodiments of the disclosure.

BRIEF DESCRIPTION OF THE DRAWINGS

FIG. 4A depicts an embodiment of a compression device on both ends of the current collector bars, where the outer ends compressed with a brace and a spring and the inner ends compressed with an expandable member (e.g. balloon), in accordance with the instant disclosure. FIG. 4B depicts another embodiment of a compression device acting on both ends of a current collector bar, where the collector bar extends across the width of the cathode. FIG. 4C depicts yet another embodiment of the cathode assembly, where the current collector subassembly has a compression device (e.g. spring member or expandable balloon) exerting a compressive force on the inner ends of the cathode collector subassembly and an anchor external to the cathode block, maintaining the current collector bar position in the slot of the cathode.

FIG. 7A depicts an embodiment comprising a balloon having solid material (e.g. sometimes called particulate substrate and/or inert material) on either sides of the balloon. FIG. 7B depicts an embodiment comprising multiple balloons (three) adjacent to one another to extend along the gap between current collector bars. FIG. 7C depicts an embodiment comprising multiple compression device balloons between the bars, where the balloons are spaced with solid material between the gaps. FIG. 7D depicts an embodiment of two cathode collector bars with a single balloon between their inner ends. FIG. 7E depicts an embodiment wherein the cathode collector bar end includes a compression device (expandable member) at the inner end of the collector bar (e.g. integral with, integrally formed, or attached to).

FIGS. 8A and 8B depict the conformation of the cathode collector bar to the cathode slot, (thus, the resulting increase in electrical contact of the cell components.).

In FIG. 9B, the arrows inside the current collector bar depict the direction of the creep in the bar (and thus, the transverse movement of the bar sides) due to the pressure (or force) exerted by the compression device on the end of the current collector bar.

FIGS. 10A and 10B depict embodiments of closing of larger macroscopic gaps (e.g. large enough gaps to be visually observable) between the block and the bar, while FIGS. 10C and 10D depict the improvement in contact between smaller scale asperities on the surfaces (e.g. slight projections on the surfaces, like those from surface roughness or unevenness). FIGS. 10A and 10C depict the block and bar interface before the compression device is utilized, while FIGS. 10B and 10D depict the block and bar interface after the compression device has imparted force onto the bar to increase the surface area of contact.

FIG. 15A depicts two compression devices, as expandable members, while

Various ones of the inventive aspects noted herein above may be combined to yield electrolysis cells and methods of operating the same to efficiently and effectively produce aluminum while using less electricity, thus lowering operating costs.

These and other aspects, advantages, and novel features of the invention are set forth in part in the description that follows and will become apparent to those skilled in the art upon examination of the following description and figures, or may be learned by practicing the invention.

DETAILED DESCRIPTION

Figure 1:
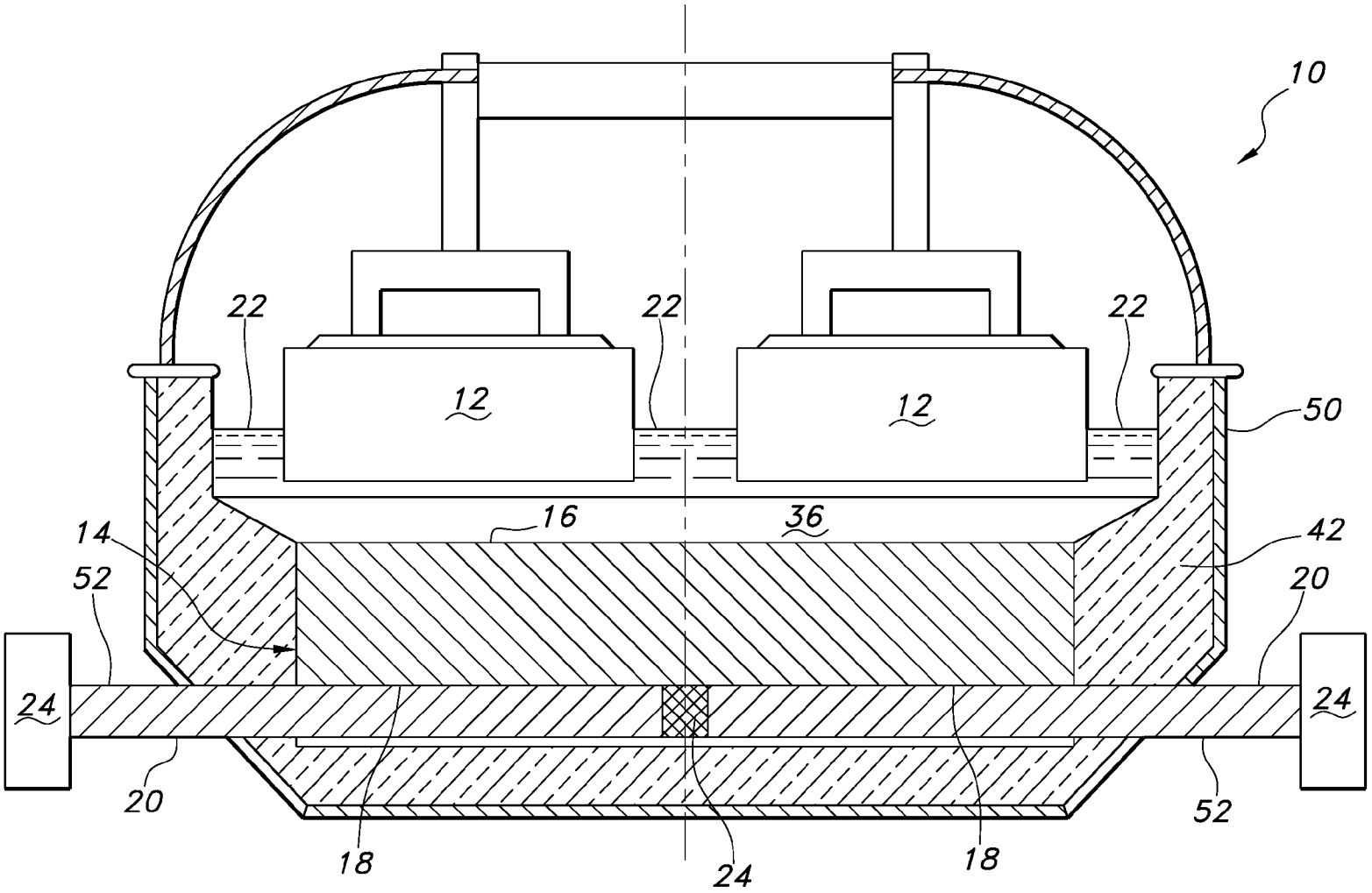
FIG. 1 is a schematic, cross-sectional side view of an embodiment of an aluminum electrolysis cell with a compression device, in accordance with the instant disclosure.

Reference will now be made in detail to the accompanying drawings, which at least assist in illustrating various pertinent embodiments of the instant disclosure, Referring to FIGS. 1 and 2, embodiments of an electrolysis cell are generally depicted. During aluminum production, the electrolytic cell 10 produces aluminum (e.g. commercially pure aluminum) at operating conditions. In some embodiments, the electrolysis cell 10 components are housed within a wall 50 (e.g. outer shell), which have refractory blocks (or material) 42 therein to insulate the system and protect the outside environment from leaks of hot electrolytic bath and/or aluminum. In some embodiments, the electrolysis cell 10 includes an anode 12, a cathode assembly 14, a liquid medium 22, and a compression device 24.

In some embodiments, the cathode assembly 14 refers to the current collector subassembly 20 and the cathode 16. The current collector subassembly 20 refers to the collector bar, the joint material, and any electrical subassembly for transferring electricity out of the cell. In some embodiments, the cathode 16 and collector subassembly 20 are in a mated position, where the current collector subassembly 20 is at least partially retained in the slot 18 of the cathode 16. In some embodiments, the ends of the current collector bar(s) extend out from the refractory 42 and wall 50. The cathode 16 refers to the carbon cathode in block form. As a non-limiting example, the cathode 16 is located at the base of the aluminum electrolysis cell 10. In some embodiments, the cathode 16 conducts the electrical current and transferring the electrical current (i.e. through its form) to exit the cell 10 via the electrical buswork (electrical buswork is not shown). In some embodiments, the current enters the cathode 16 from the liquid medium 22 (e.g. molten electrolyte). In some embodiments, the current enters the cathode 16 from the aluminum metal pad 36 (i.e. which has formed atop the cathode 16) during cell operation (aluminum production). During operation, aluminum 36 (i.e. the metal pad) is produced on the surface of the cathode 16 (see, e.g. FIGS. 1 and 2).

In some embodiments, the aluminum electrolysis cell 10 has more than one bar, for example, twenty, forty, or eighty. In some embodiments, the anode 12 emits an electrical current into the electrolytic cell 10 and into the liquid medium 22. As a non-limiting example, the liquid medium 22 includes molten salt electrolyte, and also generally refer to any intermediates, byproducts, or products formed thorough the reaction process of alumina to aluminum. In some embodiments, the electrolyte includes cryolite ($Na_3AlF_6$) and alumina ($Al_2O_3$). From the liquid medium 22, the electrical current acts to produce aluminum 16 within the electrolytic cell 10. The electrical current exits the electrolysis cell 10 through the cathode assembly 14.

In some embodiments, the cathode 16 is constructed of one or more known and accepted materials. In one embodiment, the cathode 16 is carbon. In some embodiments, the cathode 16 includes a slot 18. In some embodiments, the slot 18 is preformed along a lower surface of the cathode 16. In some embodiments, the slot 18 has a sufficient size dimension so that the current collector subassembly 20 fits at least partially into the slot 18. In some embodiments, the slot substantially encloses (surrounds) the bar. In some embodiments, the slot surrounds a portion of the bar (some but not all sides) (i.e. bottom exposed). In some embodiments, the compression device 24 is attached to an outer end and/or an inner end of the current collector bar (of the collector subassembly).

In some embodiments, the compression device 24 exerts force (or pressure) onto at least one end of the collector bar 52 such that the end(s) of the collector bar are pushed inward (e.g. in an axial direction). In some embodiments, the solid collector bar 52 thus expands in a transverse direction (e.g., generally perpendicular to the direction of the force).

Figure 2:
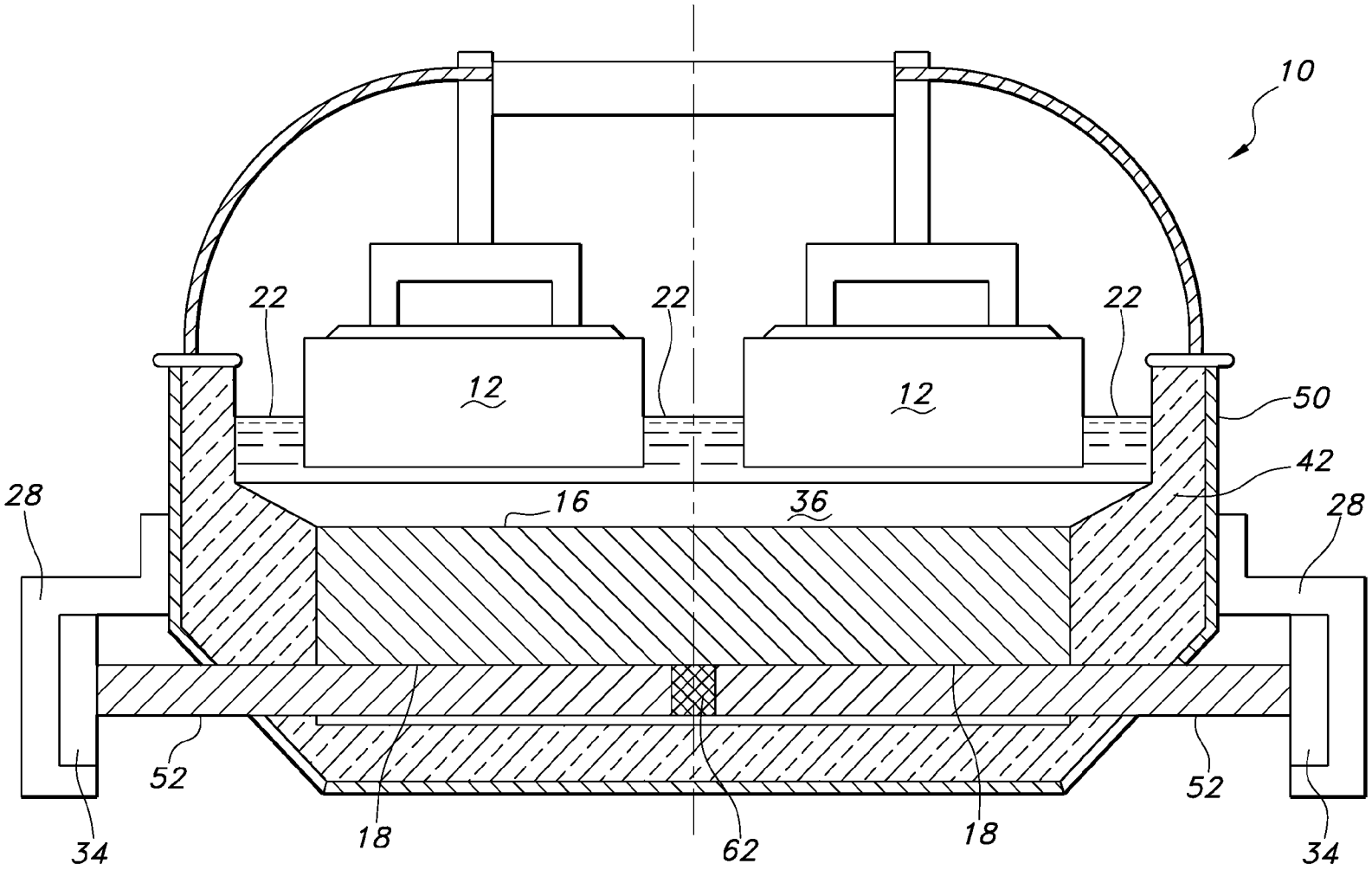
FIG. 2 is a schematic, cross-sectional view illustrating another embodiment of an aluminum electrolysis cell with a compression device comprising a brace and a force imparting element, in accordance with the instant disclosure.

Referring to FIG. 2, an embodiment of the compression device is depicted as an axial compression device 28 and force imparting element 34. In some embodiments, the axial compression device 28 fits over an end of the current collector subassembly 20 and has sufficient strength (e.g. rigidity) to allow the force imparting element 34 to expand between the end of the current collector subassembly 20 and the axial compression device 28. In some embodiments, the compression device is located at the outer ends and the inner ends of the collector bar. In some embodiments, the inner ends are spaced by a spacing material 62. In one embodiment, the spacing material includes a non-reactive material which is not degraded at operating conditions. As non-limiting examples, the spacing material can include ceramic materials, refractory materials, or the like, and may be in particulate or solid (block) forms between the cathode bar ends.

Figure 3:
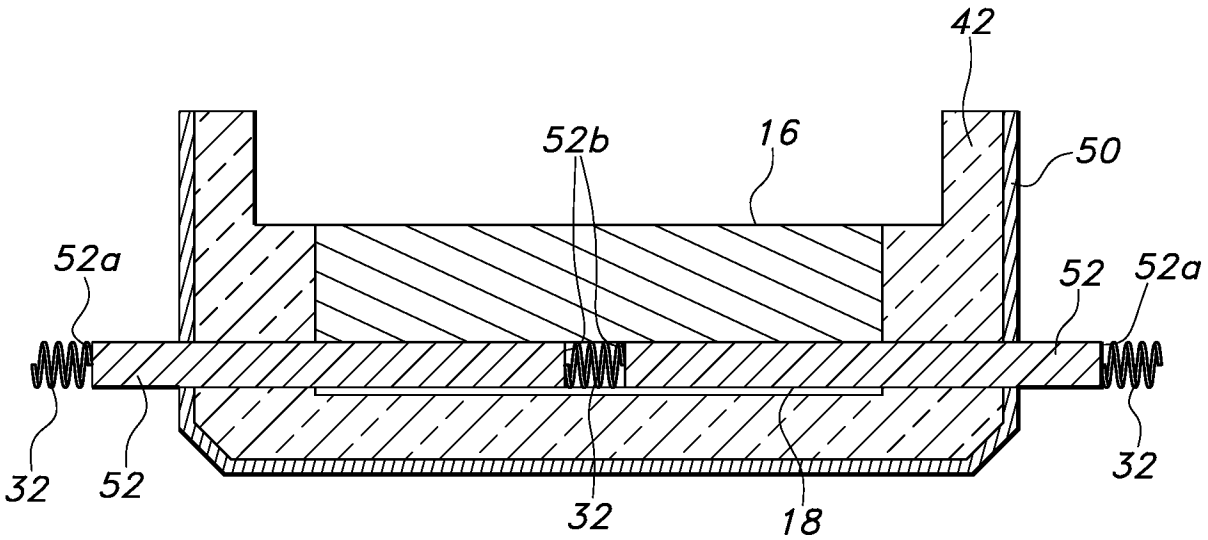
FIG. 3 is a schematic, cross-sectional partial view illustrating another embodiment of an aluminum electrolysis cell with compression devices on both ends of the current collector bars, comprising spring members on the inner and outer ends of the current collector subassembly, in accordance with the instant disclosure.

Referring to FIG. 3, the current collector subassembly 20 includes the current collector bar 52 and a joint material 54 (e.g. copper insert and/or joint). Referring to FIG. 3, the current collector subassembly 20 refers to the bar 52 (i.e. no cover of joint material). FIG. 3 depicts an embodiment of the compression device 24 in which the compression devices 24 comprise springs 32 that are located on both ends of the current collector bar 52 (inner end 52*a* and outer end 52*b*). In this embodiment, there is one spring 32 between the ends of the bars that is held within the slot of the block. In some embodiments, the compression device 24 is attached to a portion of an end of the current collector bar 52, in a position free from interfering with the electrical bus work (not shown). In FIG. 3, the brace(s) 30 on the outside springs 32 are not shown.

Figure 4A:
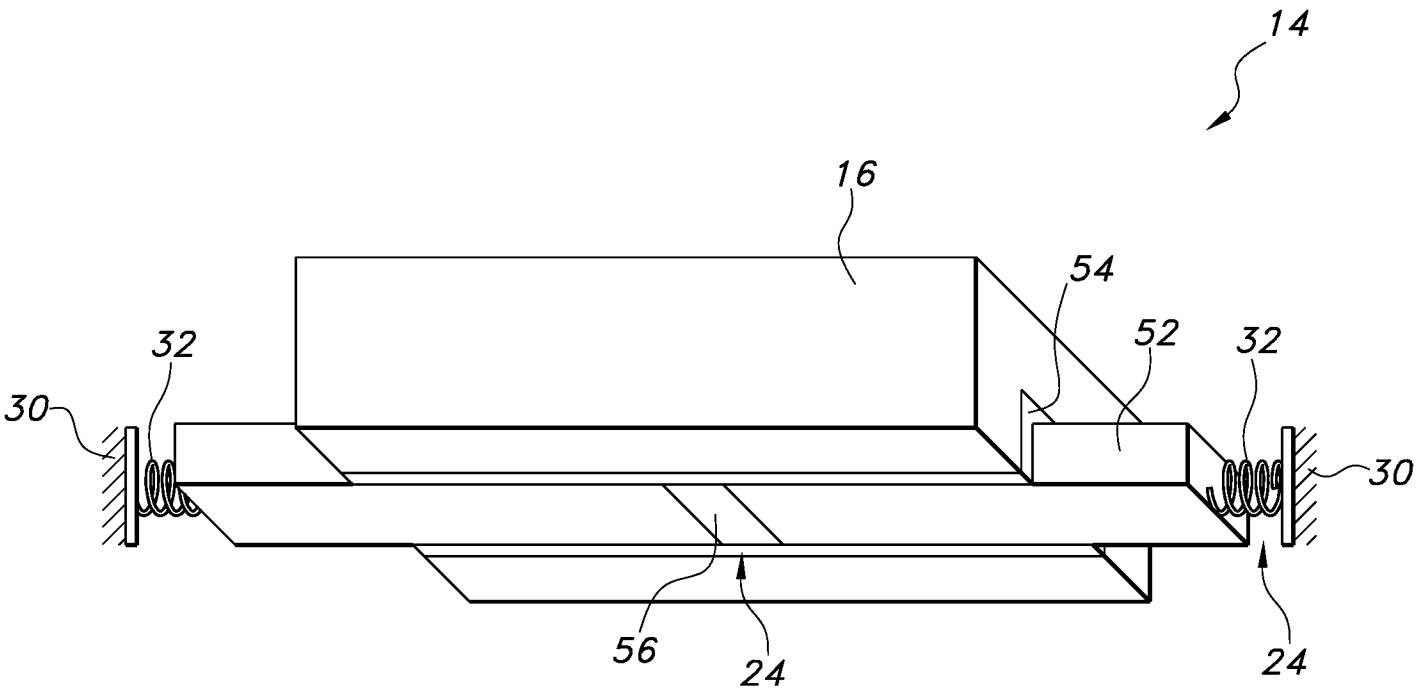
FIGS. 4A-4C depict partial schematics illustrating various embodiments of the cathode assembly.

FIG. 4A depict two embodiments of compression devices, (1) a spring 32 and brace 30 on the outer ends and (2) an expandable balloon on the inner ends. In one embodiment, the spring 32 and brace 30 are used in conjunction with two current collector bars 52 having an expandable member 56 (e.g. balloon or solid material) or between the ends that reside in the slot 18 of the cathode 16. In some embodiments, there is a solid spacing material (e.g. rigid material) is additional joint material, refractory material, or a non-reactive material between the current collector bar ends (e.g. as depicted in FIG. 2). In one embodiment, the compression device 24 attaches to the outside ends of the current collector bars, as they protrude from the electrolysis cell wall 50.

Figure 4B:
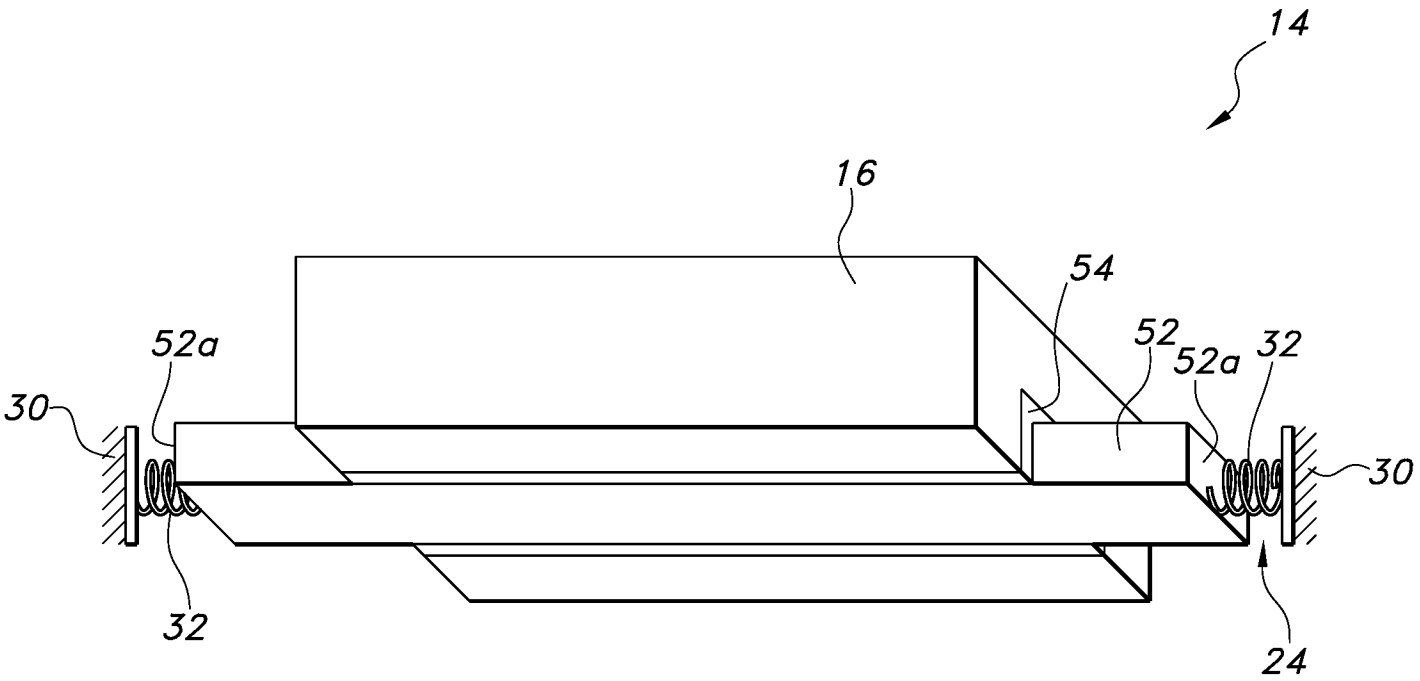

FIG. 4B depicts an alternative cathode assembly, where the current collector bar 52 extends from one end of the cathode 16 to the other end of the cathode 16 (i.e. the current collector bar does not have an "inner end"), Referring to FIG. 4B, the compression device 24 on the outer ends of the collector bar 52 is a spring 32 and brace 32. In an alternative embodiment, one outer end includes a compressive device, while the other outer end includes an anchor 70 and/or brace 30 (i.e. to restrict axial movement).

Figure 4C:
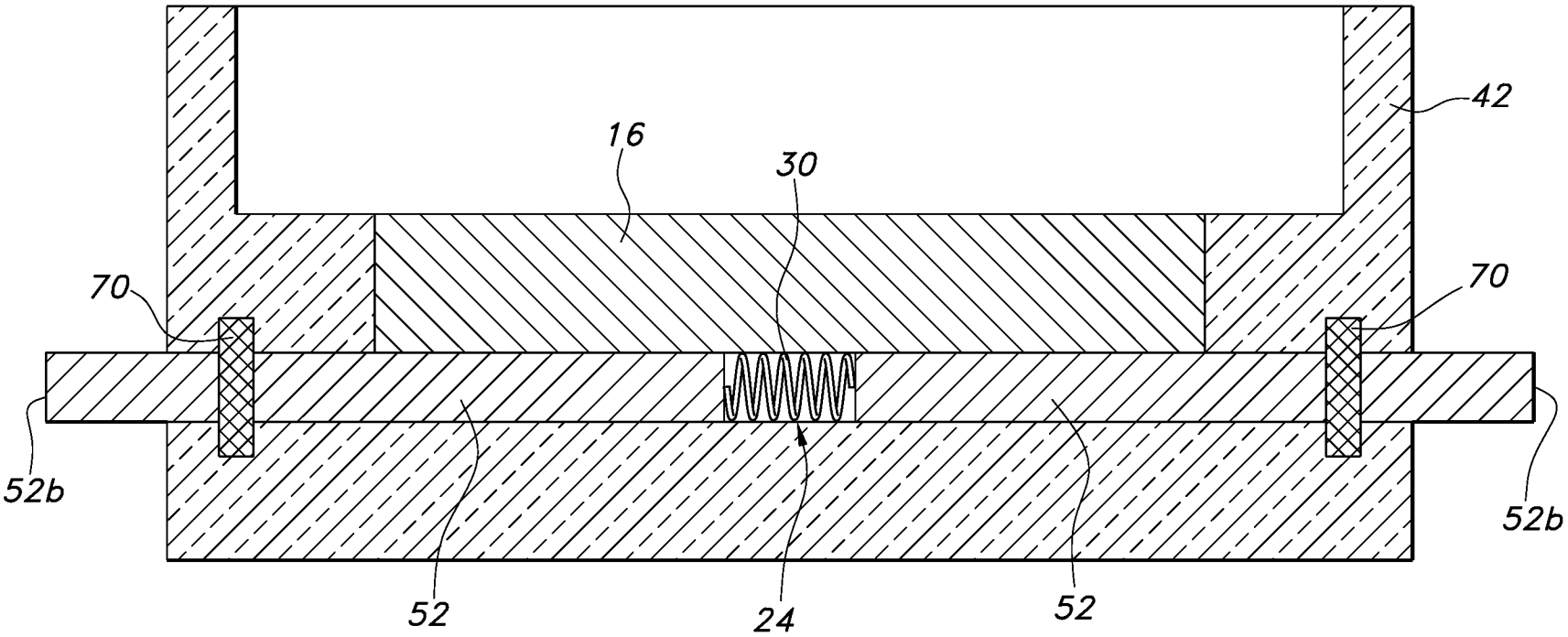

Referring to FIG. 4C yet another embodiment is depicted. FIG. 4C depicts two current collector bars in a cathode assembly, where the inner ends are adjacent to a compressive device (e.g. spring or expandable balloon). In some embodiments, the current collector bars include anchors 70 which maintain the bars 52 in place (e.g. where there are not any compressive devices on the outer ends). In some embodiments, outward free body motion of the bars 52 are restrained with anchors 70 which are attached/anchored to the pot lining 42 via anchors 70. As shown in FIG. 4C, in some embodiments, the anchors 70 are attached to the current collector bar 52 within the cell 10 (i.e. within the lining 42), but external to the cathode (i.e. away from the heat). In other embodiments, the anchors 70 may be attached to the ends or sides of the current collector bars 52, external to the cell wall 50.

Figure 5B:
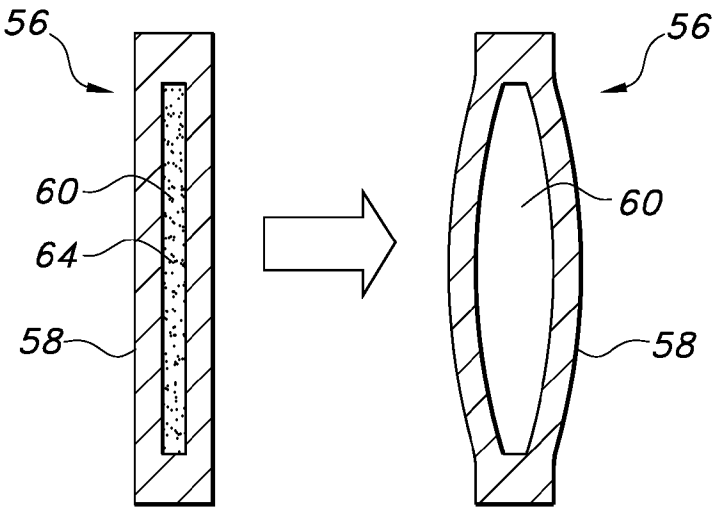
FIG. 5A-5B depict an expandable member having a gaseous void before expansion and after expansion (5A) and a gas with expandable material before and after expansion (5B).
Figure 5A:
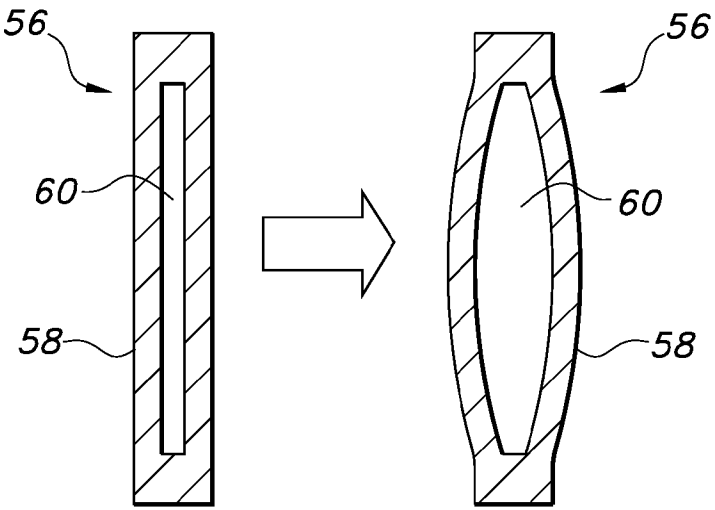

Referring to FIG. 5A, an expandable member (sometimes referred to as a metallic body or balloon) is depicted. FIG. 5A depicts the "before" heat (on the left) as compared to the "after" heat (on the right). FIG. 5A includes a gas in the inner void, which expands to push the sidewall 58 in an outward direction.

Referring to FIG. 5B, the expandable member includes a gas 60 and an expandable material 64 (on the left). After being heated, the expandable material 64 expands (via a phase change and/or chemical decomposition) and the gas expands (e.g. via the ideal gas law) increase the inner volume of the inner void and push the walls 58 outward. In some embodiments, the expandable material 64 completely transforms to gas (no solid/particulates in the void after heating, as in 5B). In some embodiments, the expandable material 64 degrades or transforms into one or more compositions, where some solid material is left in the void (e.g. after heating).

Figure 6:
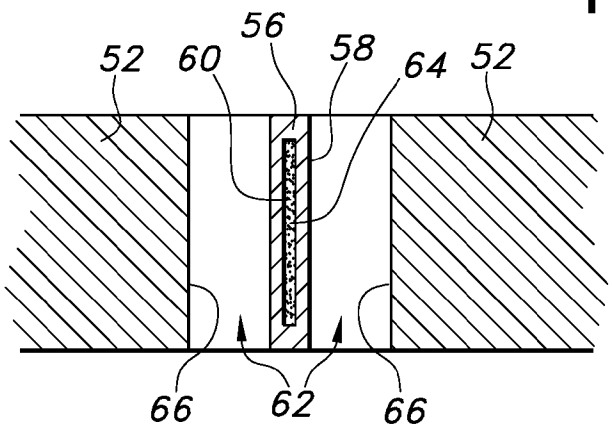
FIG. 6 depicts an embodiment of an expandable member between two inner collector bar ends, with inert material between the collector bar end and the expandable member.

Referring to FIG. 6, a compressive device 30 includes an expandable member 56, which is placed between the ends of two cathode collector bars 52. As depicted in FIG. 6, a solid spacer material 62 is provided between the sidewall 58 of the expandable member 56 and the end of the collector bar 52. As depicted in FIG. 6, the expandable balloon includes an expandable material 64 (e.g. solid, particulate form). In some embodiments, a liner 66 surrounds the spacer material and/or the expandable balloon, to limit surface interactions of the materials and to allow the expandable balloon to be easily removed from the spent pot lining once the cell is shut down. In some embodiments, where the spacer material 62 is particulate, the liner 66 retains the particulates 62.

Figure 7B:
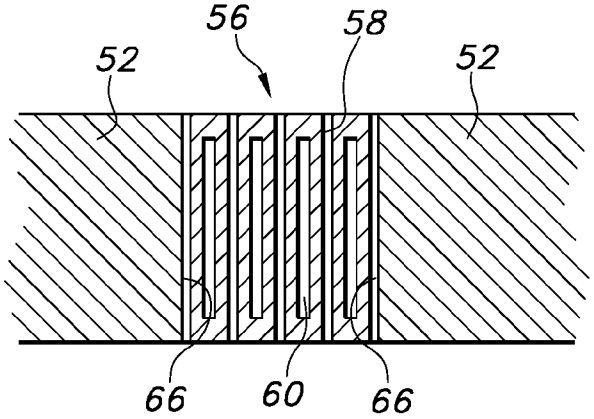
FIGS. 7A-7E depict different embodiments of a compression device on the inner ends of the current collector bars.
Figure 7A:
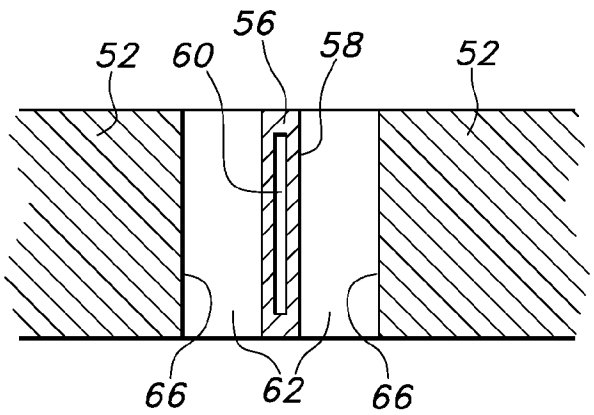
Figure 7C:
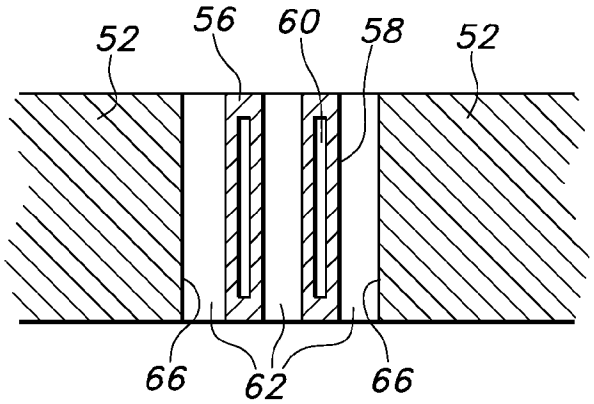
Figure 7D:
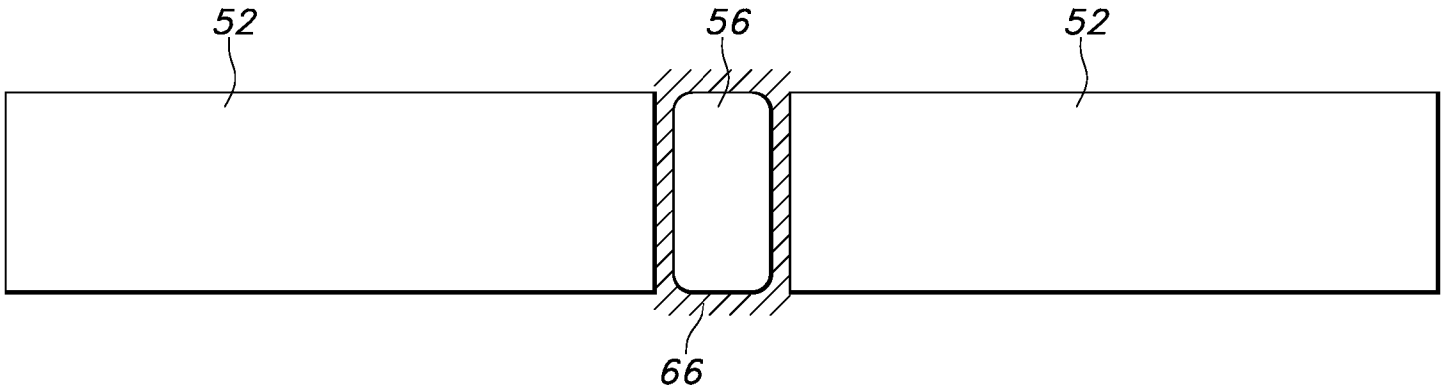
Figure 7E:
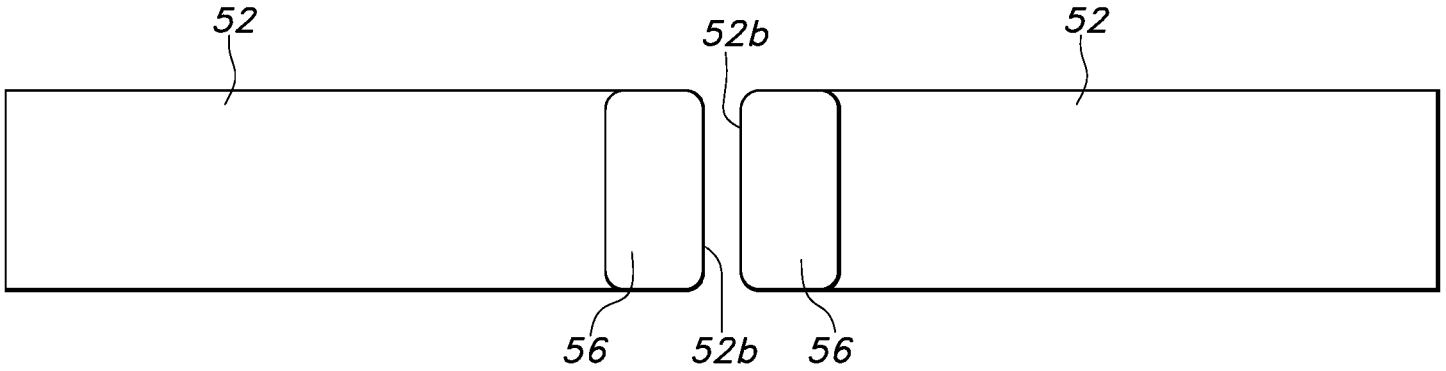

Referring to FIGS. 7A through 7E, various embodiments of the balloon-to-bar configuration are depicted. FIG. 7A has a similar configuration depicted in FIG. 6, except that the inner void includes a gas. FIG. 7B depicts a multiple expandable balloon configuration, showing four expandable balloons 58 arranged between ends of the current collector bars 52, where the outer balloons communicate directly with the inner ends of the current collector bar 52. FIG. 7C depicts an alternating configuration, with the balloons and cathode collector bar ends having spacing material 62 located between their surfaces, so that the sidewall of the balloon 58 communicates with the spacing material 62, and the spacing material communicates with the bar, FIG. 7C also provides a spacing material 62 located between and communicating with the two expandable members 56. FIG. 7D provides a small gap between the expandable balloon and the current collector bar, with a liner 66 surrounding the expandable balloon 56. In some embodiments, surrounding the balloon 56 with a liner 66 allows the balloon to be separated from the spent pot lining after electrolysis is completed. FIG. 7E depicts the expandable member 56 as part of the current collector bar 52 (i.e. at the collector bar end). In some embodiments, the current collector bar is integrally formed with the expandable balloon at its end. In some embodiments, the expandable balloon is attached to the collector bar end. In some configurations, where the collector bar includes an expandable member at its end, the collector bars: directly contact one another, contact one another via a lining 66 between the collector bar(expandable member) ends, and/or contact one another via a spacing material 62 between the collector bar (expandable member) ends.

In some embodiments, the compression device 24 is adapted to conform the current collector subassembly 20 to the slot 18 of the cathode 16. Conform, as used herein, means to adapt the shape and/or size of a first material to that of a second material. For example, a current collector bar 52 conforms to the slot 18 of a cathode 16 due to an increased amount of axial force applied to the end of the current collector subassembly 20.

In some embodiments, initially, a small amount of the collector bar is in contact with the slot, which leads to poor cell performance. After the conformation, the shape of the collector bar 52 more closely matches the size and/or shape of the slot, leading to an increased amount of direct contact (contact site) between the collector bar and the slot. This increased amount of contact facilitates improved cell 10 performance. The amount of conformation of the current collector subassembly 20 to the slot 18 is measured by a decrease in cathode voltage drop. This indicates a good attachment/connection site and thus, conformation. In some embodiments, cathode voltage drop is typically on the order of about 200 mV to about 500 mV during the operation of the aluminum electrolysis cell 10. It is believed that at least about up to 100 mV is directly due to poor (loose) electrical contact (between the slot 18 of the cathode 16 and the current collector bar 52).

In another embodiment, the compression device for pushing on the collector bars comprises an expandable member (e.g. pressurized balloon, in the form of a bladder, bellows, or a diaphragm). From the ideal gas law, the increase from ambient to operating temperature (from 20° C. to 900° C.) works to increase the pressure of the gas inside the balloon. As a result, it is estimated that the pressure inside the balloon is at least about 4 atmospheres absolute. However, there may be reductions in this pressure due to loss of oxygen (e.g. to rust) and subsequent volume increase of the balloon (e.g. metal expansion).

In another embodiment, pressures exceeding 4 atmospheres are achievable by pressurizing the balloon in advance. In one embodiment, the balloon is pre-pressurized: to at least about 5 psig; to at least about 10 psig; to at least about 15 psig; to at least about 20 psig; to at least about 25 psig; to at least about 30 psig; to at least about 35 psig; to at least about 40 psig; to at least about 45 psig; to at least about 50 psig; to at least about 55 psig; to at least about 60 psig; to at least about 65 psig; to at least about 70 psig; to at least about 75 psig; to at least about 80 psig; to at least about 85 psig; to at least about 90 psig; or at least about 100 psig.

In another embodiment, pressures exceeding 4 atmospheres are achievable by pressurizing the balloon in advance. In one embodiment, the balloon is pre-pressurized: to not greater than about 5 psig; to not greater than about 10 psig; to not greater than about 15 psig; to not greater than about 20 psig; to not greater than about 25 psig; to not greater than about 30 psig; to not greater than about 35 psig; to not greater than about 40 psig; to not greater than about 45 psig; to not greater than about 50 psig; to not greater than about 55 psig; to not greater than about 60 psig; to not greater than about 65 psig; to not greater than about 70 psig; to not greater than about 75 psig; to not greater than about 80 psig; to not greater than about 85 psig; to not greater than about 90 psig; or not greater than about 100 psig.

In another embodiment, a small amount of material is sealed inside the balloon, where the material adds to the pressure as it heats up (e.g. by a phase change to gas). For example $MgCO_3$ releases $CO_2$ gas near 350° C.

In some embodiments, the balloon is used with fillers 62 (sometimes called particulate substrates, or inert material) between the balloon sides and/or the inner ends of the collector bars. Fillers are generally selected from solid materials that maintain stiffness (e.g. rigidity) at elevated temperature. Non-limiting examples of fillers include tabular alumina, copper, and the like. In some embodiments, the balloons are welded closed, though other methods of sealing the balloons may be employed.

Figure 8B:
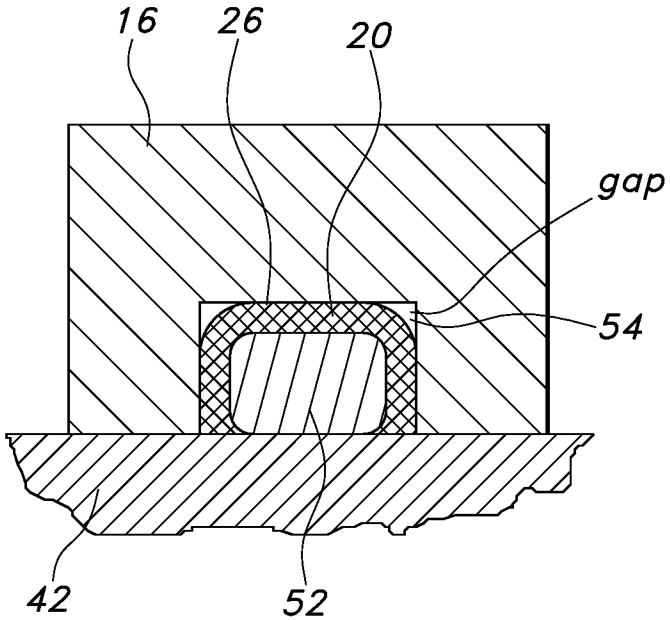
FIGS. 8A and 8B depict a side-by-side cut-away view of the slot of the cathode assembly "before" at least one compression device is in place (on the left), compared to "after" the compression device is in place (on the right), where
Figure 8A:
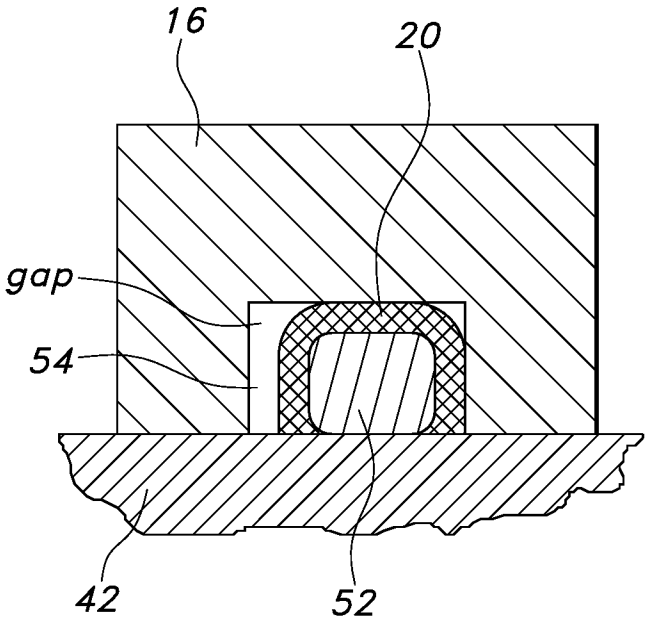

FIG. 8A-8B is a cross sectional side view, of the bar 52 in the slot 18. FIG. 8A depicts the gap, or low joint surface area/interface (FIG. 8A, on the left) compared to the high interface/surface area in the joint (FIG. 8B on the right) once the compression device conforms the current collector subassembly (including bar and joint material) to the slot 18 of the cathode 16.

Figure 9A:
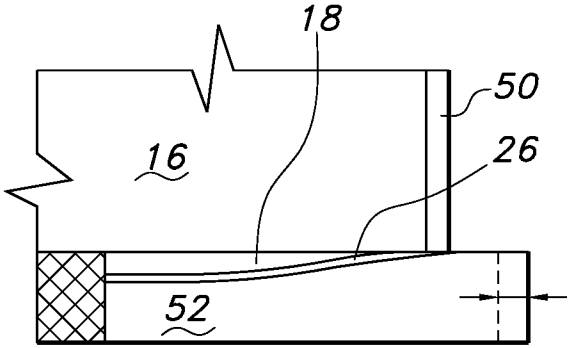
FIGS. 9A and 9B depict cut-away side views of the contact site between the cathode assembly components at operating conditions: without a compression device imparting force on the current collector bar (FIG. 9A), and with an compression device (FIG. 9B) imparting force on the current collector bar, in accordance with the instant disclosure.
Figure 9B:
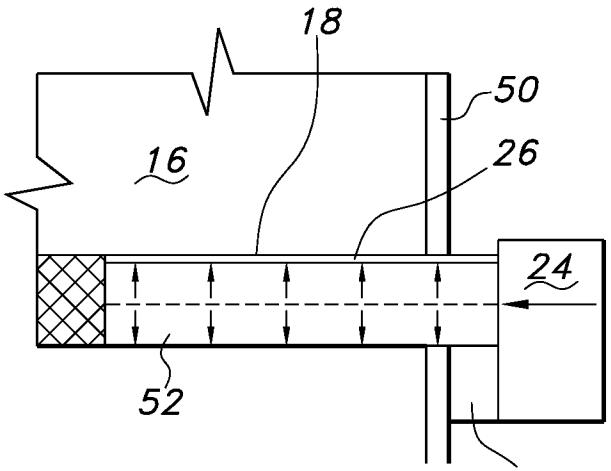

FIG. 9A-9B is a partial cross sectional front view. FIG. 9A depicts the gap, while FIG. 9B depicts the axial compression along the longitudinal axis (dotted line) of the bar 52, and the resulting transverse expansion (arrows, extending outward from dotted axis) in a generally perpendicular direction to the longitudinal axis), In some embodiments, the compression device 24 acts on the current collector bar 52 substantially along the longitudinal axis of the current collector bar 52, in parallel with the axis of the long, generally rectangular bar. In some embodiments, as force is applied at its end, the current collector subassembly 20 is axially compressed inward, towards the interior of the cell 10. In some embodiments, with axial compression at one end, the current collector subassembly 20 compensates and expands in a direction generally perpendicular to the longitudinal axis, in a substantially transverse direction to the force applied. Thus, the current collector subassembly 20 expands transversely; to align closer to and conform to the slot 18 of the cathode 16. Further, the compression device 24 is sufficiently designed to continue to apply the force required to conform the current collector bar to the slot 18 at operation conditions within the aluminum electrolysis cell.

Referring to FIG. 9B, a compression detector 38 is employed in conjunction with the compression device 24. The compression detector 38 (e.g. sensor) includes a displacement gauge which detects the amount of compression of the current collector subassembly 20. In some embodiments, this measurement is completed by measuring the relative length of the current collector bar 52 as it protrudes from the wall of the electrolytic cell 10. In some embodiments, the compression is detected by measuring the force that is imparted by the compression device 24 onto the end of the current collector subassembly 20, and correlating it to the material properties of the compression device 24 in order to determine the amount of compression within the current collector subassembly 20. In some embodiments, where the force imparting element is a spring 32, the force can be determined by measuring the spring's compression, or change in compression, from a relaxed state.

In some embodiments, the induced deformation in the current collector bar 52 by the compression device 24 causes gaps between opposing surfaces in the joint to partially, or fully close. Increasing the amount of area in contact between the cathode 16 subcomponents reduces the electrical contact resistance, to allow electricity to flow from one material to another more easily (i.e. with less resistance).

Figure 10C:
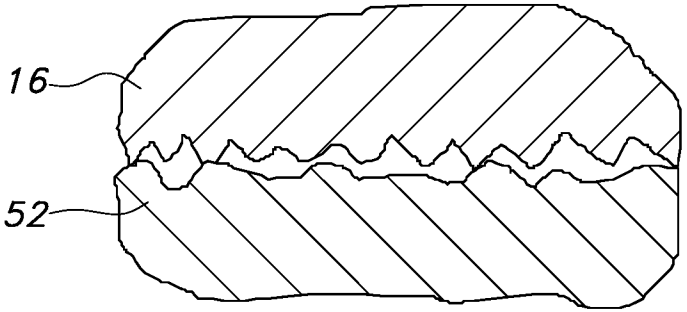
FIGS. 10A-10D depict additional embodiments of types of gaps between the cathode slot and the current collector bars, before and after, compression devices are in place. Each of the Figures depicts a close-up view of a portion of the interface (e.g. border) between the cathode block/cathode slot and the current collector bar.
Figure 10D:
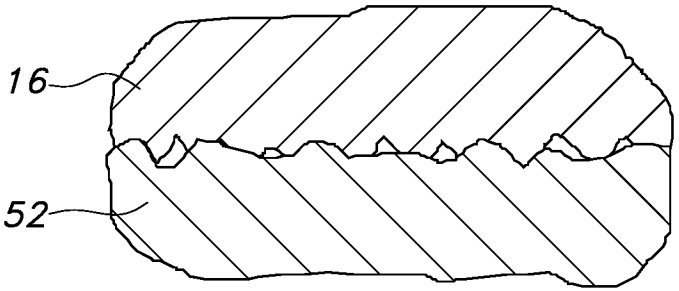
Figure 10A:
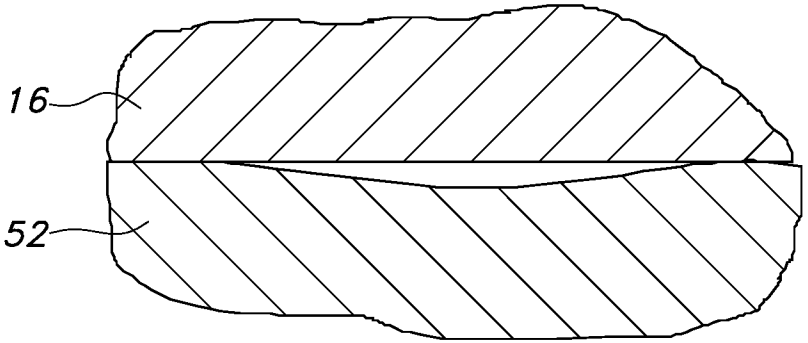
Figure 10B:
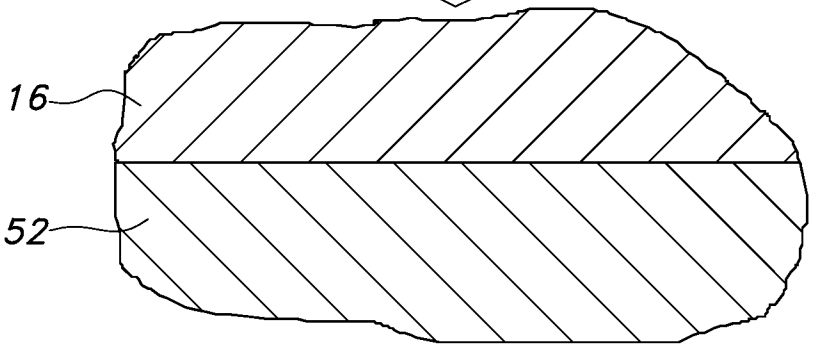

FIGS. 10A and 10B depict a before and after view of a large macroscopic gap between the cathode 16 and the current collector bar 52. In this example, once the compression device is in place, the gap appears to be completely closed. In another example, when surfaces are non-uniform, as depicted in FIGS. 10C and 10D, the frequency and/or extent of contact between the 16 and the bar 52 is increased between these smaller asperities, but the small gaps from the non-uniform surfaces are not completely eliminated. In some embodiments, the increase in contact area occurs at the interface between: (a) the slot and the joint material; (b) the joint material and the bar (c) the bar and the slot (in the absence of joint material); and (d) combinations thereof.

Figure 11:
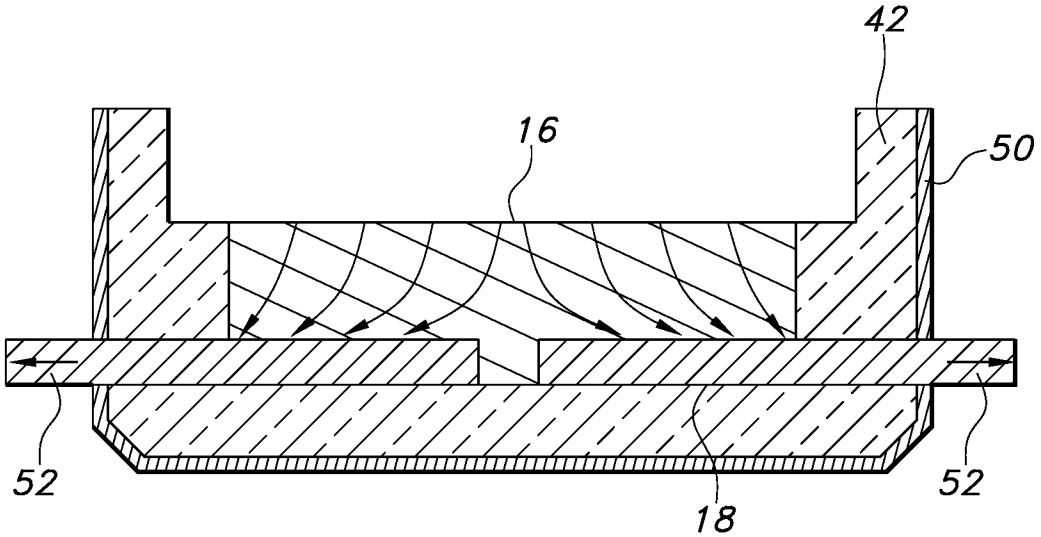
FIG. 11 depicts a partial cross-sectional view of the aluminum electrolysis cell of FIG. 4 depicting, with arrows, the general flow/path of electrical current through certain cell components.

FIG. 11 depicts an exemplary path of the electrical current from the cathode block as it moves towards the ends of the current collector bars. The electrical current is depicted by arrows. In some embodiments, the current collector bar 52 collects an electrical current from the electrolysis cell 10 (via the cathode 16) and transfers the electrical current out of the cell 10. In some embodiments, the current collector bar 52 is made of various conductive materials. As an example, the current collector bar 52 is made of metallic materials for conducting electricity. In some embodiments, the current collector bar 52 includes a joint material 54 extending along a portion of the surface of the current collector bar 52. The joint material 54 refers to a conductive material which promotes better attachment and electrical contact. In some embodiments, the joint material is located between the surface of the current collector bar 52 and the slot 18 of the cathode 16. Non-limiting examples of joint materials 54 include: metallic sheets, cast iron, copper, and/or adhesives. In some embodiments, the current collector subassembly 20 is partially disposed in the slot 18 to enable removal of electrical current from the electrolysis cell 10.

Referring to FIGS. 1-4, the current collector subassembly 20 extends out of the wall 50 of the electrolysis cell 10, thus removing the electrical current from the cell 10. The electrical current is removed from the current collector subassembly 20, and thus, the aluminum electrolysis cell 10 by electrical bus work (not shown).

In some embodiments, the compression device 24 promotes an interface 26 (or a surface) forming a common boundary between two materials. In some embodiments, the interface 26 of the current collector subassembly 20 and the slot 18 of the cathode 16 is improved as the current collector subassembly 20 conforms to the slot 18, so that electrical current is more effectively transferred from the cathode 16 to the current collector subassembly 20 (i.e. little contribution to cathode voltage drop (CVD)). By "improved", it refers to the increase in the amount of area where the subassembly and the surface of the slot are in direct contact.

A method of making aluminum is also provided. In one embodiment, the method includes the steps of: producing aluminum in an electrolysis cell while compressing the current collector subassembly (e.g. applying force). The force is imparted prior to or simultaneous with, operation of the cell. The compressing step is simultaneous with and/or sequential to aluminum production. In some embodiments, the imparting force step refers to transversely expanding the current collector bar. In some embodiments, the interface between the bar and the slot is maintained. In some embodiments, this is accomplished by monitoring and/or determining of the force imparted by the compression device. In some embodiments, if the level of compression is not continuous, the imparted force is adjusted by increasing and/or decreasing the amount of axial (longitudinal) compression. The method also includes the step of conforming the current collector subassembly to the cathode slot.

EXAMPLES

Creep and Expansion in Cathode Assembly Materials

In order to determine the minimum amount of force necessary to get appropriate creep in the collector bars at operating conditions, experiments were conducted to determine the rate of creep over periods of time for scaled-down samples of collector bar steel at operating conditions with an external force applied.

In some embodiments, at cell operating conditions, too little force may not cause enough deformation to reduce CVD, while too much force may cause the bar to deform to such an extent that the (carbon) cathode block breaks. In other embodiments, the amount of force may compromise the elasticity/springiness of the compression device, which may allow the bar free to creep out of contact in later runs/operations (i.e. insufficient compression).

Figure 12:
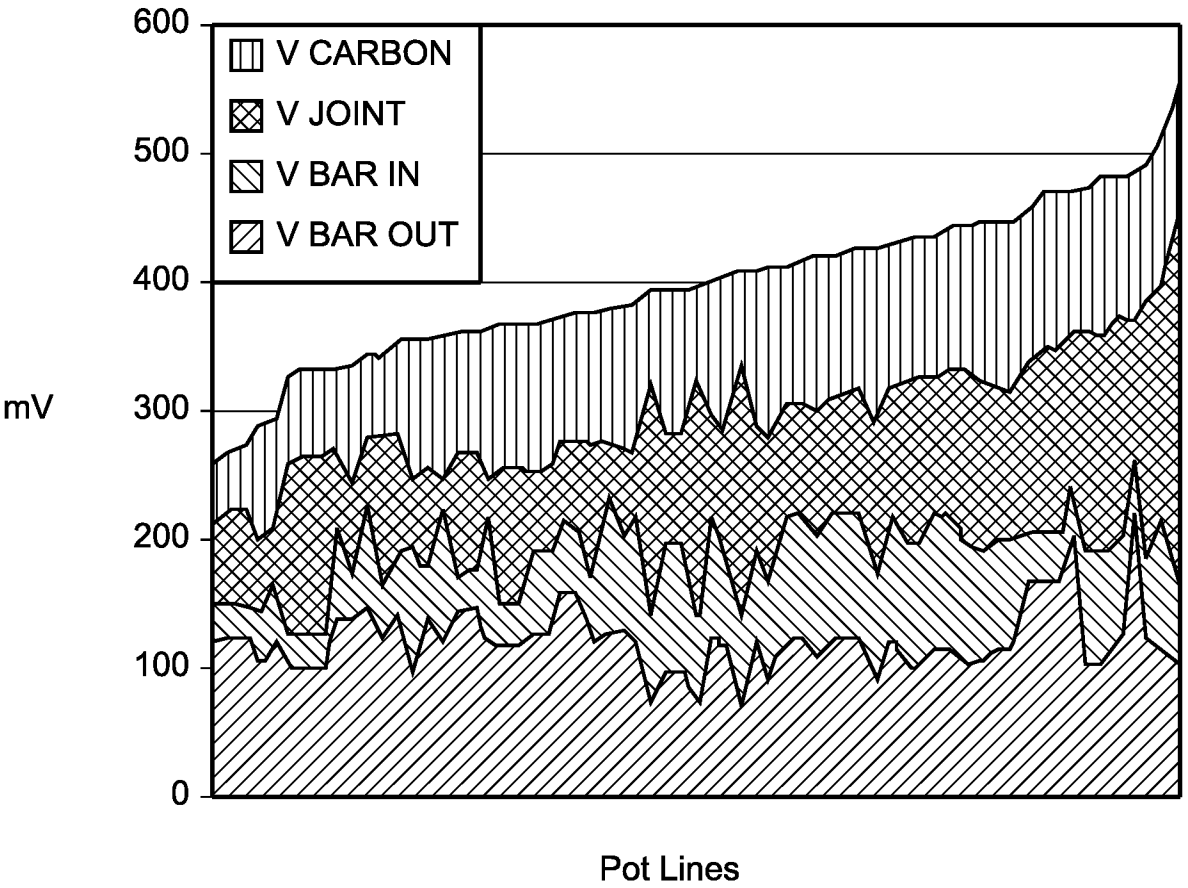
FIG. 12 depicts the voltage drop of difference cell components (carbon cathode block, joint between cathode and collector subassembly, the portion of the collector bar adjacent to (e.g. embedded in) the carbon cathode block (bar in) and the outer end of the collector bar extending outside the carbon cathode block to where the electrical bus work removes current from the cell (bar out). The horizontal axes represent changes between pot lines at various smelters.

FIG. 12 depicts a model results of the voltage loss across different components with joint (contact) resistance adjusted to match average measured CVD values from a number of pot lines in different plants with different pot types.

Figure 13:
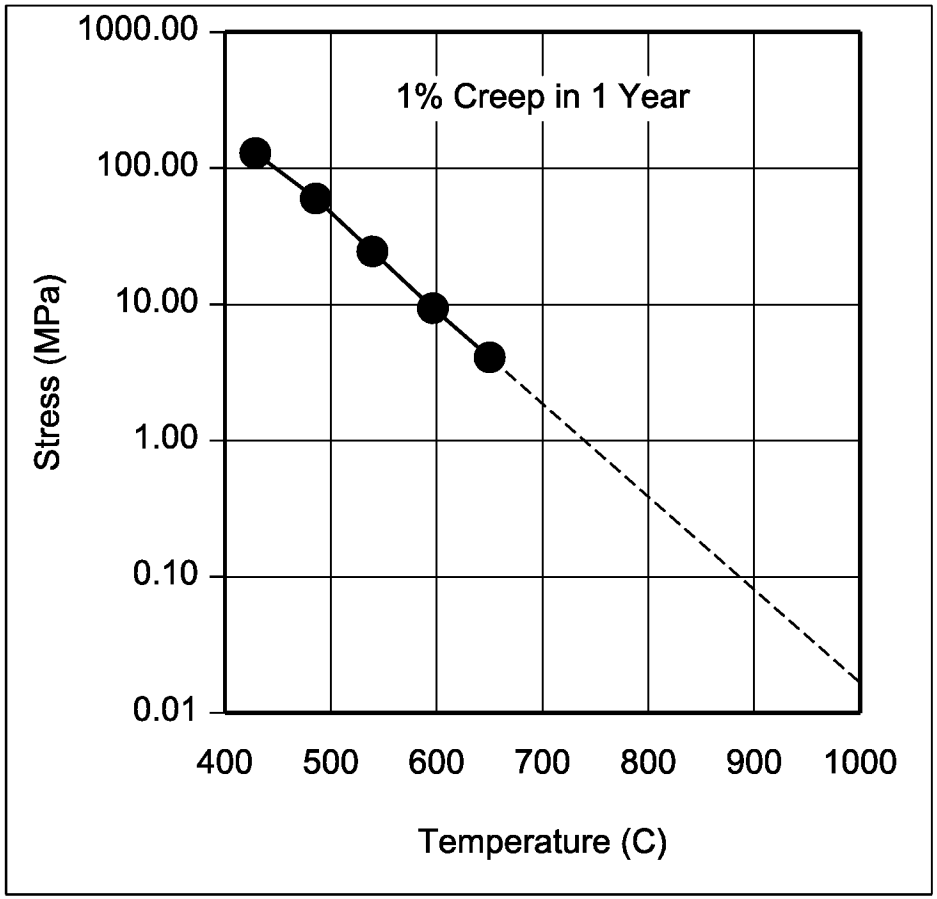
FIG. 13 is a graphical depiction of how the stress required for creep in the collector bar decreases with increasing temperature, extrapolated to pot operating temperature. The stress required to cause 1% creep over one year Stress (MPa) is plotted vs. Temperature (C).

FIG. 13 depicts how the stress required for creep in the collector bar decreases with increasing temperature, extrapolated to electrolytic cell operating temperatures, plotted as stress versus temperature.

In the system examined, the aluminum electrolysis cell operates at high temperatures and preferably has a low rate of creep. For low creep rates and high temperature, Harper-Dorn dislocation climb is believed to be a good model for secondary creep. The equation for this is:

$$\dot{\varepsilon} = A_{HD}\frac{Gb}{kT}D_0 e^{-\frac{Q}{RT}}\left(\frac{\sigma}{G}\right)$$

Under the experimental operating conditions, everything in the equation is fairly constant except strain rate ($\epsilon$) and stress ($\sigma$), and in the equation these are proportional.

Figure 14B:
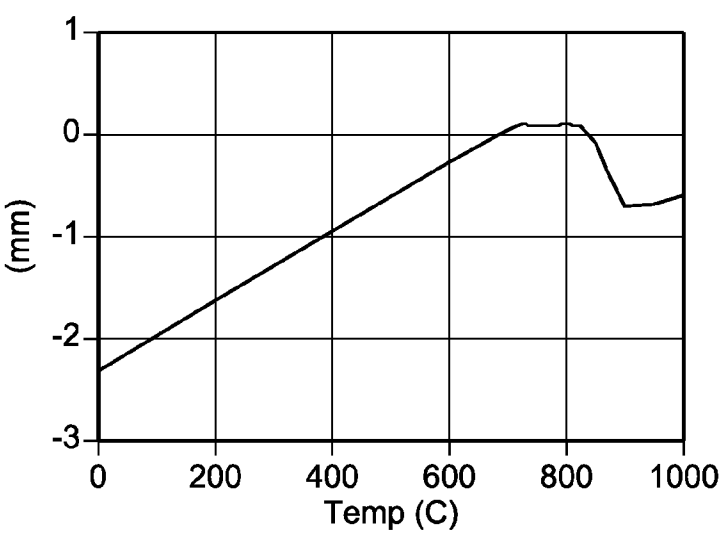
FIG. 14B depicts an example of calculated interference that results between the cathode (cath, block) and the collector bar (iron & steel) plotted as Distance (mm) vs. Temp. (C). Negative values represent a gap.
Figure 14A:
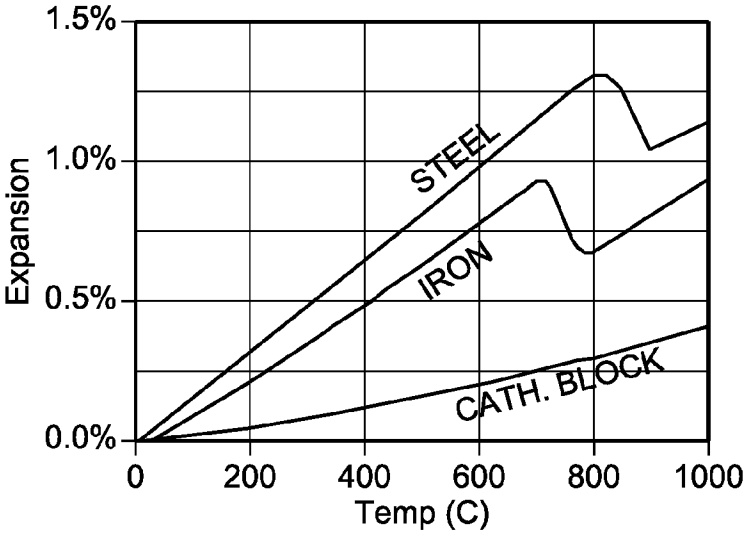
FIG. 14A depicts the differences in thermal expansion of different cathode and collector bar components, plotted as expansion (%) vs. Temperature (C).
Figure 14C:
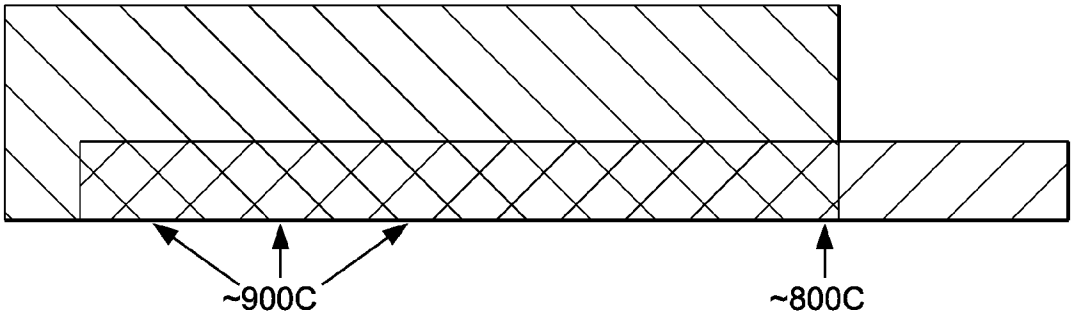
FIG. 14C depicts a cut away side view of the cathode and collector assembly, showing a difference in temperature from the inner current collector end (−900° C.) and the transition to the outer collector bar end (−800° C.).

FIG. 14A depicts the different thermal expansion of the cathode block material versus collector subassembly materials (steel and iron) at different temperatures. FIG. 14B depicts an example of the calculated gap (distance, measured in mm) versus temperature (C). FIG. 14C depicts that under operating conditions, the collector bar (of the depicted configuration) exhibits different temperatures along its length (e.g. ~900° C. towards the inner end, and ~800° C. towards the outer end (i.e. near where the bar leaves the cathode block, yet still inside the cell wall).

Example 1

Bench Test of Creep on Collector Bar Material

Bench tests were conducted to determine the creep for a certain load/force on the collector bars. In each test, a two inch long, ¾ inch diameter rod of 1018 steel was loaded with a 50 pound weight (113 psi). Two tests were conducted, where one sample was held in compression for one week at about 930° C., and the other sample was held at compression for two weeks at about 930° C.

The resulting test specimens became slightly shorter and wider. The first sample gave an axial strain rate of 0.0015%/hr. The second sample gave an axial strain rate of 0.0012%/hr. The widening rate, which is needed to improve the joint, was 0.0019%/hr for the first sample and 0.00074%/hr for the second sample. It should be noted that in the first test the diameters were measured with less precision, which may explain the high value of 0.0019%/hr, as compared to the second sample. These results indicate that with reasonable applied forces onto the current collector bar, widening of the bar into the slot of the cathode block is achievable. Thus, electrical contact is increased, joint resistance is decreased, and CVD is decreased.

Example 2

Bench Test of Compression Device (Expandable Balloons)

Figure 15B:
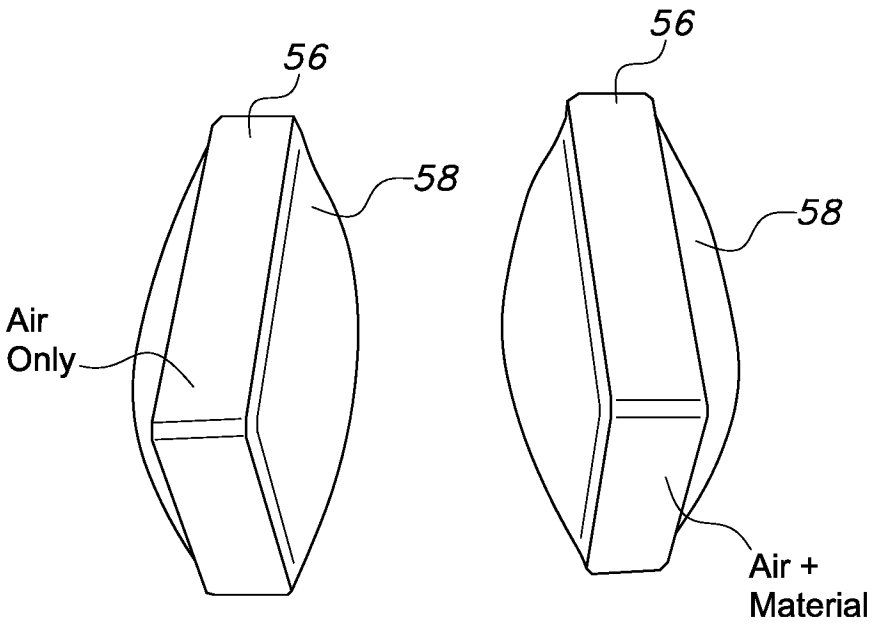
FIG. 15B depicts the expandable balloons in an expanded state, with walls expanded in an outward direction.
Figure 15A:
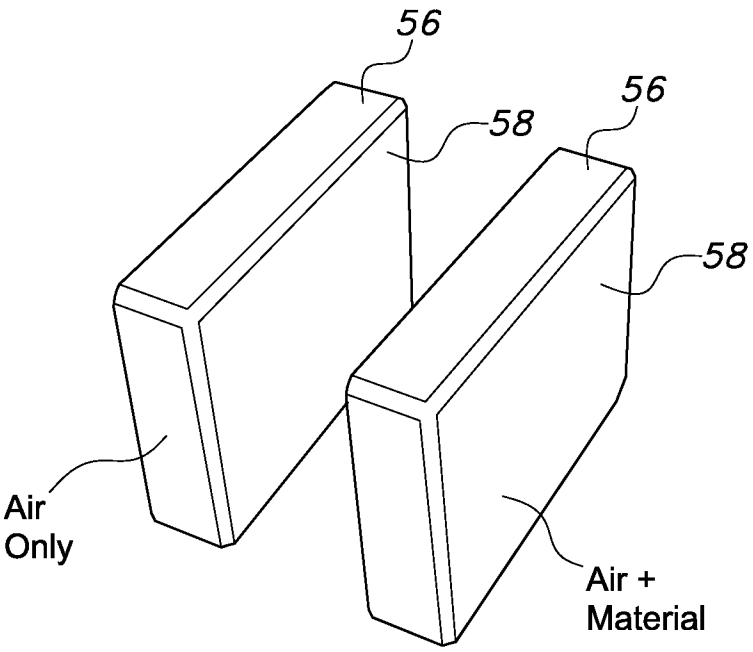

FIGS. 15A and 15B depict a perspective view of two expandable members (e.g. steel balloons), shown side by side. (While these balloons are rectangular, other shapes are possible.) FIG. 15A depicts the balloons before expansion and FIG. 15B depicts the balloons after expansion.

Example 3

Bench Test of Compression Device (Expandable Balloon)

Figure 16:
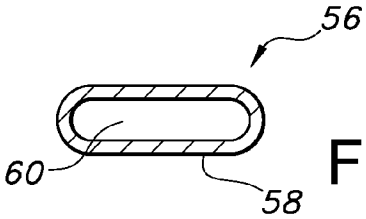
FIG. 16 depicts an exemplary cutaway side view of the expandable balloons used for the trial depicted in FIG. 17.
Figure 17:
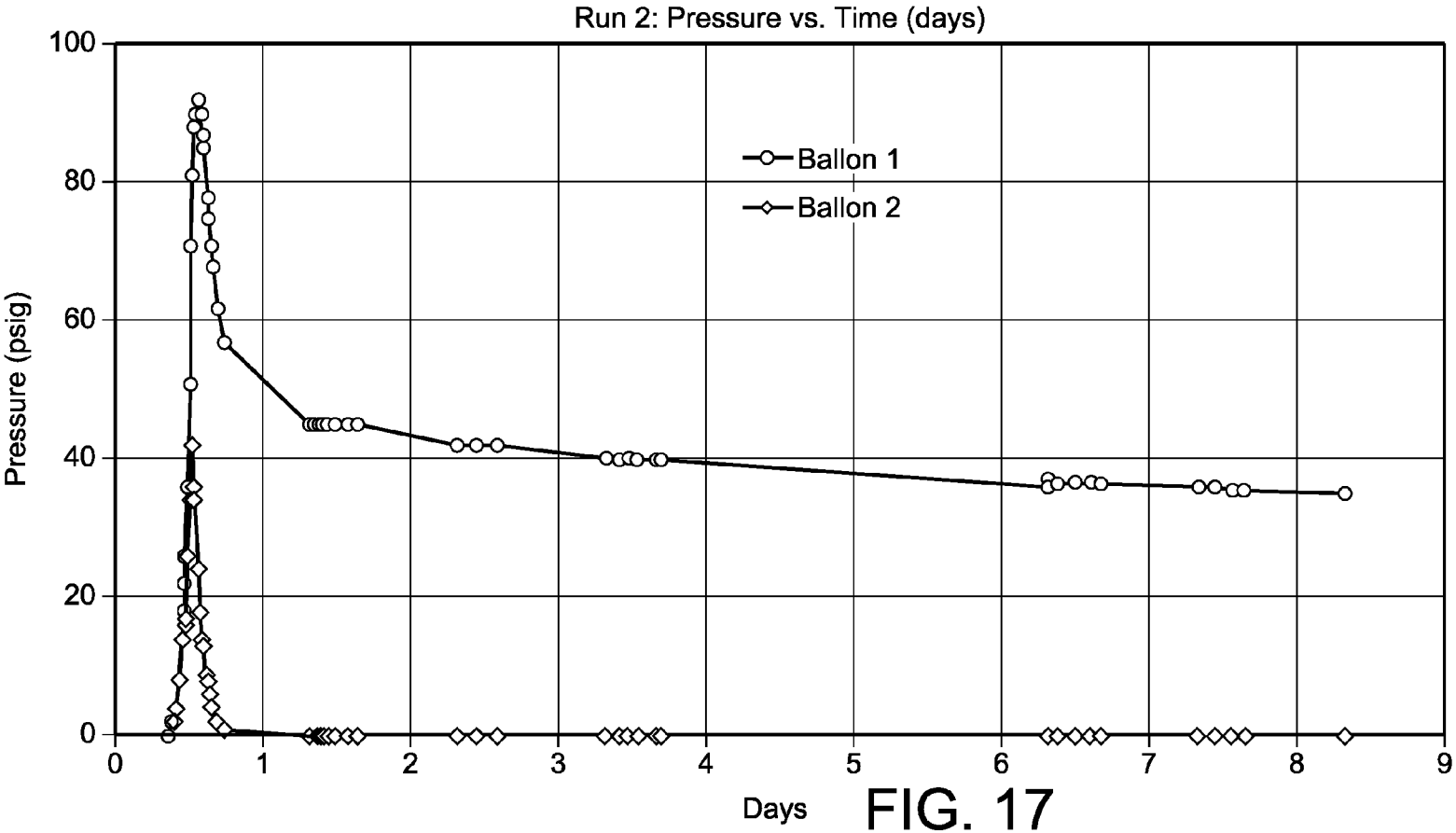
FIG. 17 depicts the trial run of two expandable balloons, depicting the Pressure (PSIG) as a function of Time (Days).

Another set of expandable members were constructed, both with rounded edges as depicted in the cross-sectional view of FIG. 16. Both balloons had 1 gram of $MgCO_3$ which released $CO_2$ resulting in the pressure increase between 350° C. and 450° C. Balloon 1 was constructed of ¼" carbon steel walls, while Balloon 2 was constructed of ⅛" stainless steel walls. For each balloon, the walls were sealed with welds. FIG. 17 is a chart that shows the pressure in the two balloons over time (delays). While Balloon 2 failed (did not retain pressure) due to an inadequate weld, Balloon 1 maintained a substantial pressure throughout the trial period.

Example 4

Figure 18:
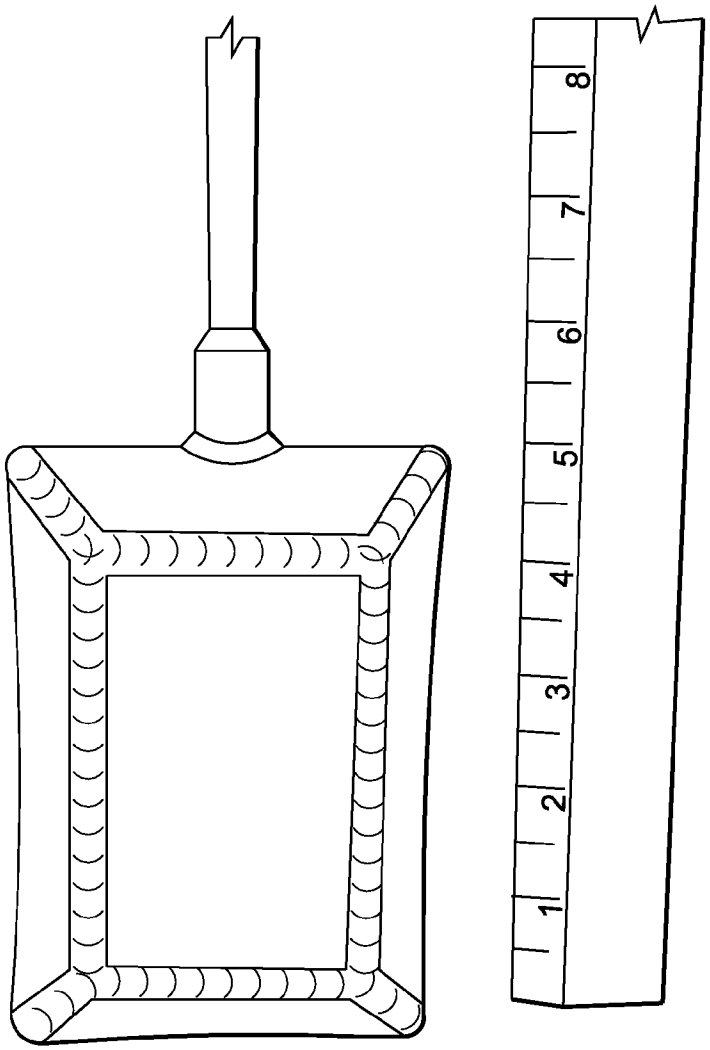
FIG. 18 depicts a plan side view of an expandable member of a second trial run.
Figure 19:
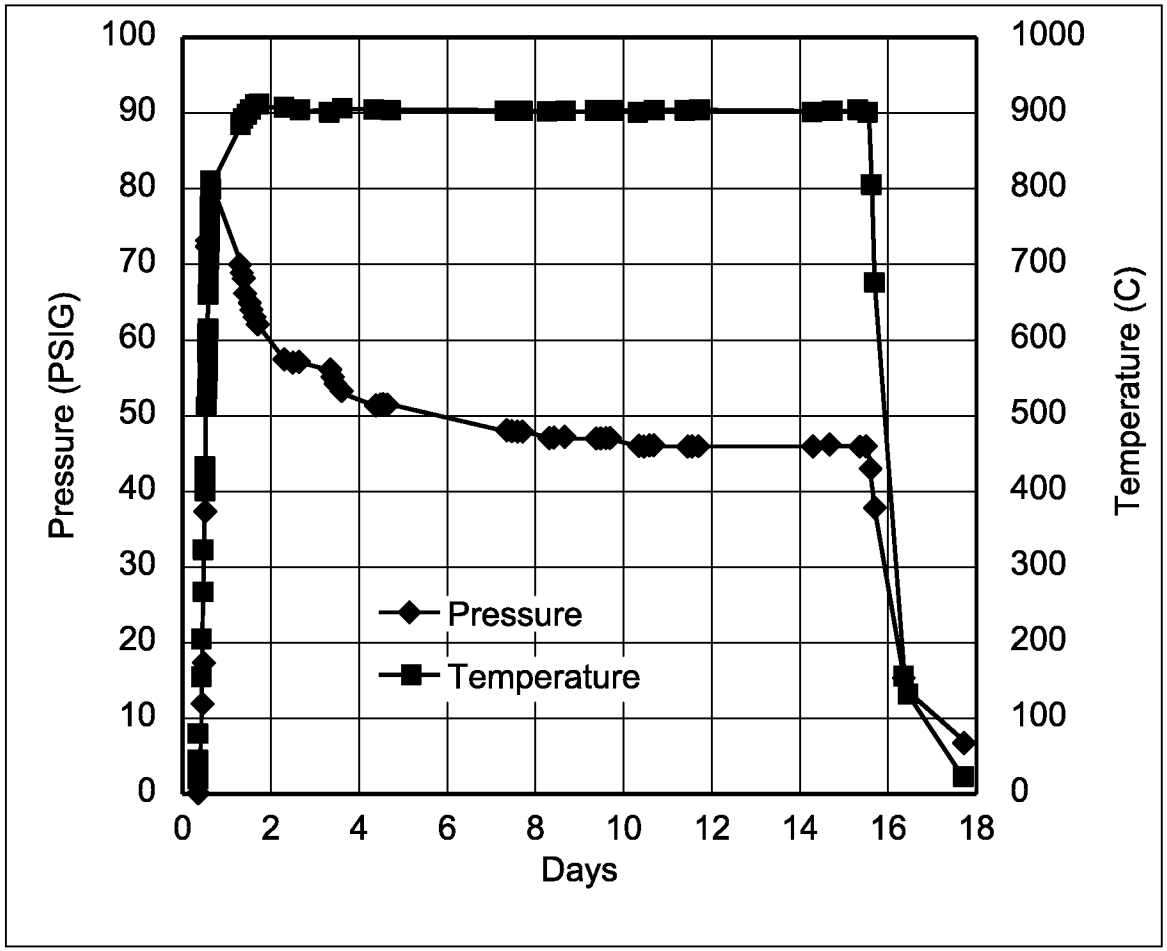
FIG. 19 depicts the resulting pressure (PSIG) and Temperature (C) as a function of Time (days).

Referring to FIGS. 18 and 19, another steel balloon was constructed and underwent a 16-day experimental trial. The balloon had walls that were approximately ⅛ inch thick and the balloon was constructed of 304 stainless steel, as depicted in FIG. 18. The balloon faces are made of flat plate, while the rounded sides were cut from half sections of tube. The faces and edges (e.g. rounded edges) were attached by welding. This test balloon had nominal external dimensions of 5×3.5×1.25 inches. It contained 1 gram of $MgCO_3$, which contributed to the internal pressure by releasing $CO_2$ gas at the elevated temperature. The test balloon was partially constrained during the test, so that the "inflated" thickness of the balloon increased only by about ⅜ inch. It should be noted that the pressure tap located near the top of the test balloon was only for measuring the internal pressure of the test piece, and did not supply pressure to the test balloon.

Throughout the test (over a two-week period), the balloon maintained significant pressure at a temperature of approximately 900° C. There were no leaks observed in the balloon. It is estimated that this structure, in an electrolysis cell start-up and/or operating conditions, would cause significant permanent deformation of a collector bar in an operating pot, i.e. to prevent, reduce, and/or eliminate a gap between the cathode collector bars at the cathode slot.

Referring to FIG. 19, the chart plots the internal pressure of the balloon and temperature, as a function of time during the test (over a 18 day period). Without being bound to a particular mechanism or theory, the initial increase in pressure to a peak of 91 PSIG was believed to be driven by both the temperature (as per the ideal gas law) and release of $CO_2$ from the one gram of $MgCO_3$ powder inside the balloon, while the subsequent decrease in pressure was believed to be due to the volume expansion of the test piece, and possibly also due to the absorption of some gas species by the steel (perhaps nitrogen). It was observed that the pressure was extremely steady over the final week of the test (e.g. day 7-~16) at approximately 46-47 psig (as depicted).

It should be noted that the final drop in pressure (at the end of the test) was due to the drop in temperature (e.g. removal from heat), and not due to a leak. The test piece maintained a reduced positive pressure after the test, (e.g. as would be expected under the ideal gas law.)

Example 5

Bar Deformation with Expandable Balloon

Figure 20:
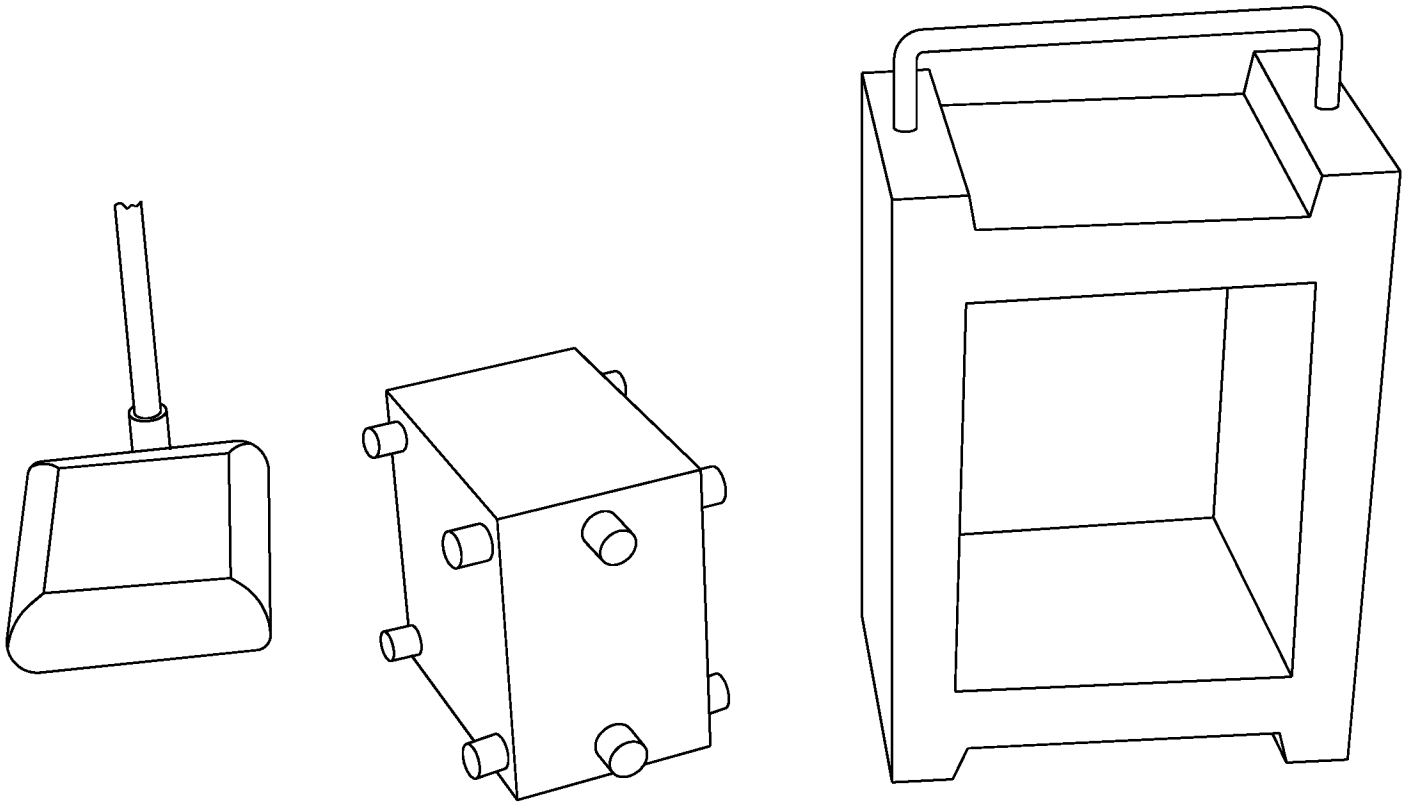
FIG. 20 depicts the components of Example 5, including the frame, the balloon (compression device) and the collector bar component) prior to assembly into the tested configuration.
Figure 22:
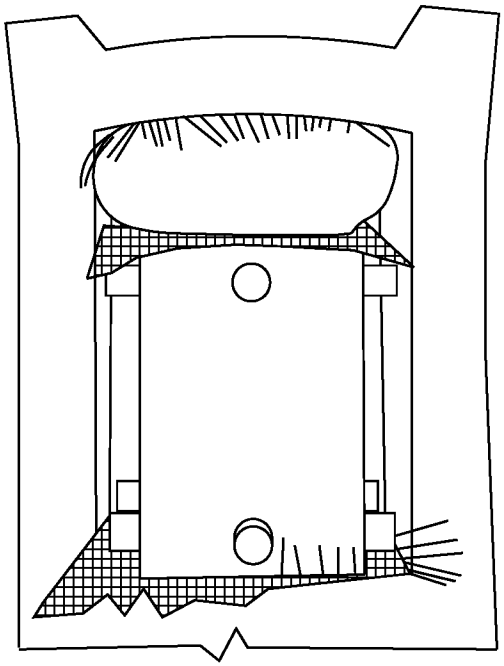
FIG. 22 depicts the assembled configuration for Example 5, after testing.

An experiment was performed to test whether an expandable member (steel balloon) was capable of enough compression to deform an industrial sized collector bar cross section, Referring to FIG. 20, this bench test used a steel frame (right) to constrain a steel balloon (left) and a short (4.5" high) collector bar (middle) with a cross section of (3"×4.5"). The assembled components before the test are depicted in FIG. 21, while the assembled components after the test are depicted in FIG. 22.

In order to read the pressure during the experiment, the balloon was fitted with a tube leading to a pressure gauge. (In a real cell, this pressure gauge would be omitted.) The balloon contained 4 grams of $MgCO_3$, which was believed to decompose and release $CO_2$ gas (near 350° C.) as the configuration heated up to cell operating temperature of approximately 900° C. The resulting $CO_2$ which is generated inside the balloon in turn pressurized the balloon, which, in combination with the elevated temperature conditions, resulting in the balloon's walls deforming/bowing outward and imparting pressure (compressing) the adjacent collector bar and frame.

Figure 21:
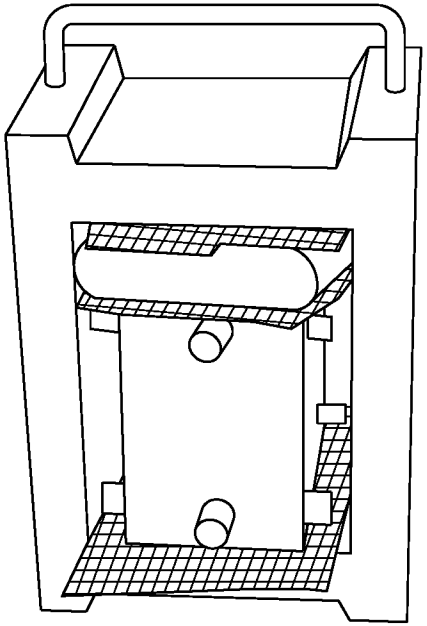
FIG. 21 depicts the assembled configuration of Example 5, before testing.

FIG. 21 depicts the bar and balloon restraining frame, with the bar and balloon inserted into the frame.

Thermocouples were placed near the inside top and bottom of the frame. Graphite cloth was used between the balloon-to-frame and bar-to-balloon contact points to prevent steel pieces from touching and welding together at temperature. The configuration was surrounded by packing coke and an argon purge, to prevent oxidation of the carbon steel frame and collector bar. The balloon was constructed of 304 stainless steel plate and 304L stainless steel tube, both nominally 0.125" thick. The balloon's external dimensions were 4"×5.5"×1.25".

The collector bar was fitted with stainless steel pins for measuring the vertical deformation. Referring to FIG. 22, while the vertical compression of the bar is not apparent to the naked eye, the bending stresses developed in the restraining frame were high enough to cause visible deformation.

Figure 23:
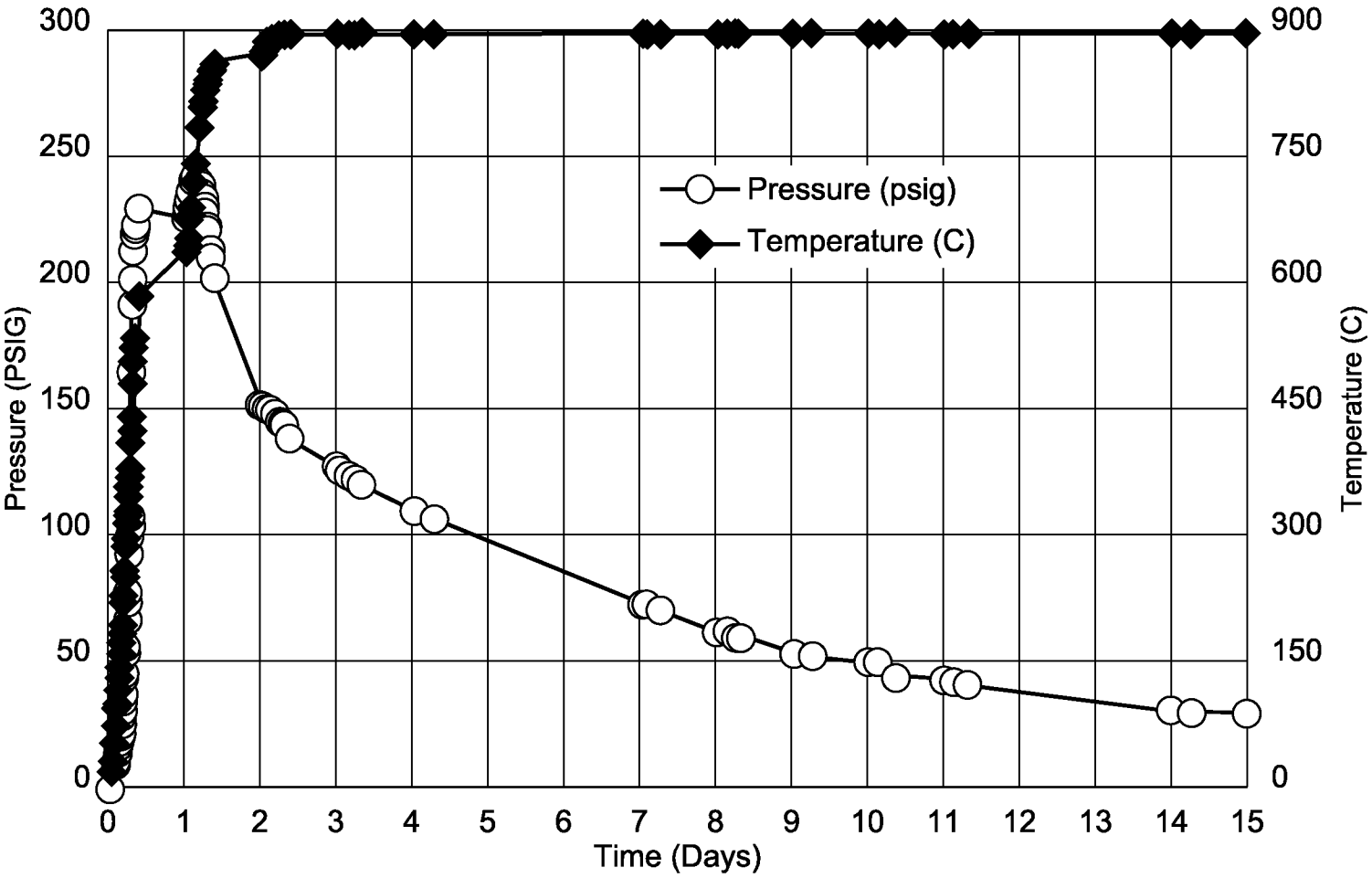
FIG. 23 is a graphical representation of pressure and temperature vs. time (in days) for Example 5.

FIG. 23 depicts the average temperature and balloon pressure over the course of the test (depicted as a function of time, in days), Referring to FIG. 23, the temperature was brought up to 600° C. during the first day and then up to 900° C. on the second day, where it stayed for two weeks. Referring to FIG. 23, the pressure peaked near 250 psig, then decreased rapidly (at first), followed by a more gradual decrease in pressure. By the end of the test, the pressure was at about 30 psig. Without being bound to a particular mechanism or theory, it was believed that some pressure was lost inside of the balloon due to surface reactions between the CO2 generated and the inner steel surface of the balloon.

Measurement of the inside and outside pin spacing as well as measurement of the full bar height showed a total compressive strain (shortening) of about 0.14% in a longitudinal direction over the course of the test, as depicted in Table 1, below. This would correspond to a fattening across the width (transverse direction) of about 0.07% (which is about half of the strain in the longitudinal direction).

TABLE 1

Measurements for total height change and change in average pin position give total strain during the bench test. Pins were numbered in six vertical pairs.

| | Full Bar Height at Corners | | | |
|---|---|---|---|---|
| | 1-2 Corner | 3-4 Corner | 4-5 Corner | 6-1 Corner |
| Before | 4.634 | 4.608 | 4.596 | 4.623 |
| After | 4.6305 | 4.598 | 4.586 | 4.619 |
| Strain | −0.076% | −0.217% | −0.218% | −0.087% |

| | Pins | | | | | |
|---|---|---|---|---|---|---|
| | Pin 1-1 | Pin 2-2 | Pin 3-3 | Pin 4-4 | Pin 5-5 | Pin 6-6 |
| Outside Before Test | 4.0007 | 3.9998 | 4.0002 | 4.0003 | 3.9996 | 4.0000 |
| Inside Before Test | 3.0030 | 3.0025 | 3.0030 | 3.0040 | 3.0035 | 3.0030 |
| Outside After Test | 3.9985 | 3.9985 | 3.9960 | 3.9980 | 3.9920 | 3.9950 |
| Inside After Test | 3.0020 | 2.9980 | 2.9970 | 3.0000 | 2.9930 | 2.9960 |
| Strain | −0.046% | −0.083% | −0.146% | −0.090% | −0.258% | −0.171% |

Average of all Strains −0.14%

Referring to Table 1, the measurements taken across the width of the bar showed fattening (negative strain values refer to a reduction in size in a longitudinal direction, thus an increase in size in a transverse direction).

By extrapolating these results to a larger collector bar (e.g. about 4.25" wide) in an operating cell (as opposed to a furnace at cell operating temperature), the strain is expected to correspond to a deformation of the bar in a transverse direction (bar "fattening") of roughly 0.003. This was only about half of the expected 0.07%. Without being bound to a particular mechanism or theory, this may be attributed to "end effects" which refers to the changes occurring at one end of the bar and/or the limited number of measurements.

Without being bound to any mechanism or theory, this amount of deformation in the bar is believed to be sufficient to reduce CVD in an operating pot.

Without being bound to any mechanism or theory, this amount of deformation is believed to be approximately one order of magnitude smaller than the air gap which is expected to be formed over a collector bar's surface due to bar bending during rodding (formation of the cathode collector assembly).

Without being bound to any mechanism or theory, this amount of deformation is also believed to be about one half of the interference fit that makes the difference between no contact and perfect electrical contact in a copper insert collector bar.

Therefore, while more deformation (from pressure being maintained longer) would result in a greater reduction in CVD, the amount of deformation achieved with this configuration is believed to be sufficient to significantly reduce CVD.

Further, without being bound by any mechanism or theory, the Harper-Dorn dislocation climb suggests that creep rate at temperature is proportional to compressive stress. Given the aforementioned, by integrating the pressure history and incorporating the measured creep, it's possible to provide a relationship for the creep rate:

$$\dot{\varepsilon} = \frac{-1.4\times10^{-6}}{psig\ \text{day}}\times\sigma$$

While various embodiments of the instant disclosure have been described in detail, it is apparent that modifications and adaptations of those embodiments will occur to those skilled in the art. However, it is to be expressly understood that such modifications and adaptations are within the spirit and scope of the instant disclosure.

What is claimed is:

1. An aluminum electrolysis cell, comprising:

an anode;

a cathode assembly, having a cathode block, a slot in the cathode block, and a current collector subassembly, wherein the current collector subassembly is at least partially disposed in the slot; and an axial compression device, adjacent to an end of a current collector subassembly and adapted to apply an axial force onto an end of the current collector subassembly, wherein via the axial compression device, the current collector subassembly is configured to expand in a transverse direction such that it is conformed to the slot, and wherein the axial compression device is located entirely external from the current collector subassembly.

2. The aluminum electrolysis cell of claim 1, wherein the axial compression device comprises:

a spring member adapted to apply force to an end of the current collector bar; and a brace adapted to hold the spring in place on the end of the collector bar.

3. The aluminum electrolysis cell of claim 1, wherein the axial compression device comprises:

an adjustable bracket having a screw and a threaded assembly, wherein the adjustable bracket is adapted to fit on an outer end of the current collector subassembly.

4. The aluminum electrolysis cell of claim 1, wherein the axial compression device comprises:

a metallic balloon having at least one wall, where the wall encloses a gas-filled void, wherein the metallic balloon is adjacent to an inner cathode collector subassembly end, inside the slot.

5. The aluminum electrolysis cell of claim 1, wherein the axial compression device comprises:

a metallic balloon having at least one wall, where the wall encloses a material that undergoes a phase change at a temperature exceeding about 100° C.;

wherein the metallic balloon is adjacent to an inner cathode collector subassembly end, inside the slot.

6. The aluminum electrolysis cell of claim 5, wherein the material comprises:

$MgCO_3$, $CaCO_3$, and combinations thereof.

7. The aluminum electrolysis cell of claim 1, further wherein the axial compression device is configured to attach to a wall of the aluminum electrolysis cell.

8. The aluminum electrolysis cell of claim 1, further wherein the axial compression device increases the electrical contact between the cathode collector subassembly and the cathode.

9. The aluminum electrolysis cell of claim 1, further wherein the interface comprises a common surface area sufficient to reduce a measured cathode voltage drop by at least about 50 mV.

10. The aluminum electrolysis cell of claim 1, wherein the compression device imparts force onto the end of the current collector subassembly to axially compress the current collector subassembly to maintain the interface between the current collector subassembly and the slot of the cathode block.

11. The aluminum electrolysis cell of claim 1, wherein the current collector subassembly further comprises a bar; a joint material; and combinations thereof.

12. An aluminum electrolysis cell, comprising:

an anode;

a cathode block with at least one slot;

at least one pair of current collector bars, wherein each current collector bar is partially disposed in the slot such that an inner end of each of the current collector bars are opposed from each other in the slot; and an axial compression device including:

at least one metallic balloon located in the slot, between the inner ends of the cathode collector bars; and at least one brace adapted to fit onto each of the current collector bars adjacent to an end of the current collector bar, wherein the brace is configured to apply force onto the current collector bar ends;

wherein at least one of the current collector bars is conformed to the slot via the axial compression device; and wherein the axial compression device is located entirely external from the current collector bars.

13. The apparatus of claim 12, wherein the axial compression device is adapted to configured to apply axial force to the inner ends and outer ends of the current collector bars, thus transversely expanding the current collector bar.

14. The apparatus of claim 12, wherein the axial compression device conforms the current collector bar to the slot of the cathode block to maintain an interface.

15. The aluminum electrolysis cell of claim 12, wherein the force imparting element increases the interface between the cathode block and the current collector bar by up to about 2%.

16. The aluminum electrolysis cell of claim 12, wherein the axial compression device further comprises:

a compression detector located between the brace and the force imparting element, wherein the compression detector is configured to measure the force imparted on the collector bar.

17. A method of making aluminum, comprising:

(a) producing aluminum in an aluminum electrolysis cell, wherein the producing comprises transmitting electrical current from an anode to a cathode assembly, via a liquid medium, wherein the cathode assembly comprises:

a cathode block, a slot in the cathode block, and a current collector subassembly, which is at least partially disposed in the slot; and an axial compression device attached to an end of the current collector subassembly;

wherein the axial compression device is located entirely external from the current collector subassembly; and (b) compressing at least one end of a current collector subassembly via the compression device, such that the current collector subassembly is transversely expanded to conform to the slot; and (c) maintaining, due to the compressing, a contact between the slot of the cathode block and the current collector subassembly.

18. The method of claim 17, further comprising:

conforming the current collector subassembly to the cathode block to reduce the cathode voltage drop (CVD) from about 10 mV to about 100 mV.

19. The method of claim 17, further comprising:

transversely expanding the current collector subassembly via the compressing step to maintain an electrical contact between the current collector subassembly and the slot of the cathode block, wherein the electrical contact is greater than an initial electrical contact, prior to the radial expansion of the current collector bar.

20. The method of claim 17, wherein the compressing step comprises:

adjusting the compression of the current collector subassembly by the compression device; and conforming, due to the adjusting step, the current collector subassembly in a transverse direction, towards a surface of the slot.

21. The method of claim 1, wherein the axial compression device is adapted to apply the axial force on an inner end of the current collector subassembly.

22. The method of claim 1, wherein the axial compression device is adapted to apply the axial force on an outer end of the current collector subassembly.

* * * * *